US009408520B2

(12) United States Patent
Vacca et al.

(10) Patent No.: US 9,408,520 B2
(45) Date of Patent: Aug. 9, 2016

(54) INVERTIBLE DISHWASHING RACK AND RELATED METHODS

(71) Applicants: Rosario Vacca, Murrieta, CA (US); Ronald L. Pawlak, Tucson, AZ (US)

(72) Inventors: Rosario Vacca, Murrieta, CA (US); Ronald L. Pawlak, Tucson, AZ (US)

( * ) Notice: Subject to any disclaimer, the term of this patent is extended or adjusted under 35 U.S.C. 154(b) by 544 days.

(21) Appl. No.: 13/781,604

(22) Filed: Feb. 28, 2013

(65) Prior Publication Data

US 2013/0233353 A1 Sep. 12, 2013

Related U.S. Application Data

(60) Provisional application No. 61/605,356, filed on Mar. 1, 2012.

(51) Int. Cl.

| | |
|---|---|
| ***B08B 3/00*** | (2006.01) |
| ***A47L 15/50*** | (2006.01) |
| *A47L 15/00* | (2006.01) |

(52) U.S. Cl.

CPC ..... *A47L 15/50* (2013.01); *A47L 15/501* (2013.01); *A47L 15/0076* (2013.01); *Y10T 29/49826* (2015.01)

(58) Field of Classification Search

None

See application file for complete search history.

(56) References Cited

U.S. PATENT DOCUMENTS

2006/0119236 A1* 6/2006 Dickson ..... A47L 15/504 312/311

2011/0064549 A1* 3/2011 Carpinelli ..... A47L 15/501 414/405

* cited by examiner

*Primary Examiner* — Eric Golightly

(74) *Attorney, Agent, or Firm* — Acuity Law Group, P.C.; Daniel M. Chambers

(57) ABSTRACT

A substantially rectangular dish rack having a substantially single side walled body portion that slidably engages two identical base portions, which interchangeably function as either the top or bottom of the dish rack. The top and bottom portions are preferably both inserted into the body portion from the same side of the body portion. Any of the four sides of the top and bottom portions may be inserted first into the body portion, and when inserted into the body portion, the base portions are held in place by friction catches or latches. The friction latches preferably include a boss portion and a notch portion to receive the boss portion. Alternative embodiments include designated top and bottom portion and are color coded to signal the identity of each. The body portion is preferably constructed to allow for extension of the body portion to allow for different heights of dishwares, by collars which are attachable and detachable to and from the body portion by prongs and sockets, which mutually engage on another.

7 Claims, 24 Drawing Sheets

INVERTIBLE DISHWASHING RACK AND RELATED METHODS

RELATED APPLICATION

This application claims the benefit of and priority to commonly owned U.S. provisional patent application Ser. No. 61/605,356, filed 1 Mar. 2012, which is herein incorporated by reference in its entirety for any and all purposes.

FIELD OF THE INVENTION

The present invention relates generally to the racks for dishware and to racking, transporting, pre-washing, machine washing, draining, drying, storing and dispensing of glassware, cups, tumblers, dishes, bowls, and other like dishware, tableware and kitchenware. More specifically, the present invention relates to stackable racking and washing systems which are preferably adapted to be vertically reversible (i.e., flipped or inverted) even when filled with racked wares, to allow for the performing of all washing and ware-handling requirements without the need for the removal, inversion, and reinsertion of the individual wares.

BRIEF DESCRIPTION OF THE RELATED ART

The current state of the art for commercial dishware/glassware dishwashing is to collect the dirty glassware from the tables and place them into a rack. The typical rack has dividers so that each item of glassware is separated from the next. The dishware or glassware is placed in the rack "open end" up, so as to not spill its contents. The rack is then brought into the dishwashing area where each item of glassware is removed from the rack, turned over and placed back into the rack so that the "open end" is now facing down. Then, the rack is ready to pass through the dishwasher.

The main purpose of this current process is to quickly clear the dining area and reset the table. Once the full rack of dirty dishware or glassware is in the dishwashing area, the dishware or glassware must typically be removed and turned over to effectively pass through a commercial dishwashing machine.

One object of this invention is to eliminate the messy and time consuming process of removing and turning over each piece of glassware.

SUMMARY OF THE INVENTION

The problems discussed above are overcome with various embodiments of the invention. Preferred embodiments of the present invention include a dishware rack that can be flipped over, thus eliminating the need to remove and turn over each item in the rack. The bottom of the rack, or "pilot," is removable. The primary objective of the present invention is to provide a dish or ware rack that allows for the accomplishment of all necessary ware-handling functions without the necessity of removing, inverting, and replacing the wares individually by hand. These functions preferably include the gathering from dining areas of wares stored vertically upright and containing leftover liquids; vertical inversion of the full racks of wares in a pre-washing area to empty liquids from the wares; pre-washing of the racked wares, and their draining by vertical inversion; direct insertion of the racks full of wares into commercial dishwashing systems; post-washing vertical inversion of the racks for final draining and drying of the wares; re-inversion of the racks for storing and stacking of racks; chilling or icing of the wares; and re-dispensing and reuse of the wares.

The present invention preferably includes a three-piece structure to save time, labor and space, and will reduce any losses due to breakage of dishwares from excessive handling. Because the dishwares need not be removed from the dish racks from the time they are gathered until the time they are dried and ready for reuse, the risk of breakage from the handling of wet dishwares is substantially reduced. Additionally, because the dish racks include both top and bottom portions, the dishwares are more substantially protected while inserted as compared to known methods and devices.

In certain embodiments the top and bottom portions are identical and interchangeable, and the construction of the two base portions allows any of the respective four sides of the base portions to be inserted first into the body portion where it is received. This allows for the removal and reinsertion of the base portions without regard to their directional dispositions, and without regard to whether they are to be inserted as the top or as the bottom portion.

Preferred embodiments also include a body portion that is constructed so as to allow for extension of the body portion to allow for different heights of dishwares, by means of collars, which are attachable and detachable to and from the body portion utilizing prongs and sockets that mutually engage each other. The dish racks are preferably stackable and shaped to mutually engage when the bottom of one dish rack is placed upon the top of another.

One preferred method of using the product is as follows: a rack full of dirty glassware is placed over a sink or spill safe area. A top or bottom portion is slid into the top of the base portion and latched into position, enclosing the glassware completely. The rack is then flipped over. All the glassware is now open-end down and their contents can spill out. Now that the rack is flipped, the bottom portion that was secured to the bottom of the base portion is now on the top. Next, the top portion can be removed. The dish rack is then ready to pass through the dishwasher.

The disclosure herein further discusses methods to describe the various methods in which the racks of the present invention are preferably used.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

BRIEF DESCRIPTION OF THE DRAWINGS

In the drawings, in which corresponding reference numerals and letters indicate corresponding parts of the various embodiments throughout the several views, and in which the various embodiments generally differ only in the manner described and/or shown, but otherwise include corresponding parts.

DETAILED DESCRIPTION OF PREFERRED EMBODIMENTS

The preferred dish rack 10, illustrated in FIGS. 1-5, is rectangular (in side view) and includes a substantially single side walled body portion 30, which slidably engages two preferably identical and optionally interchangeable top or bottom portions 12, 14 that selectively function as either the top or bottom of the dish rack 10 when it is fully assembled. The top and bottom portions 12, 14 are preferably both inserted into the body portion 30 from the same side of the body portion 30.

Preferably, the base portion 30 is configured in such a way that the top and bottom portions 12, 14 may be inserted into any of the four sides of the base portion 30, and when inserted into the body portion 30, the top and bottom portions 12, 14 are held in place by friction catches or latches 50*a* including a boss portion and a notch portion to receive the boss portion. An alternative embodiment includes a base portion 30 that is differentiated into a top portion and a bottom portion and each portion is color coded in alternate drawings available from the inventors to signal the identity of each. In preferred embodiments, the body portion 30 is constructed to allow for extension of the body portion to allow for different heights of dishwares, by means of substantially rectangular collars (described elsewhere herein), which are attachable and detachable to and from the body portion 30.

Figure 1:
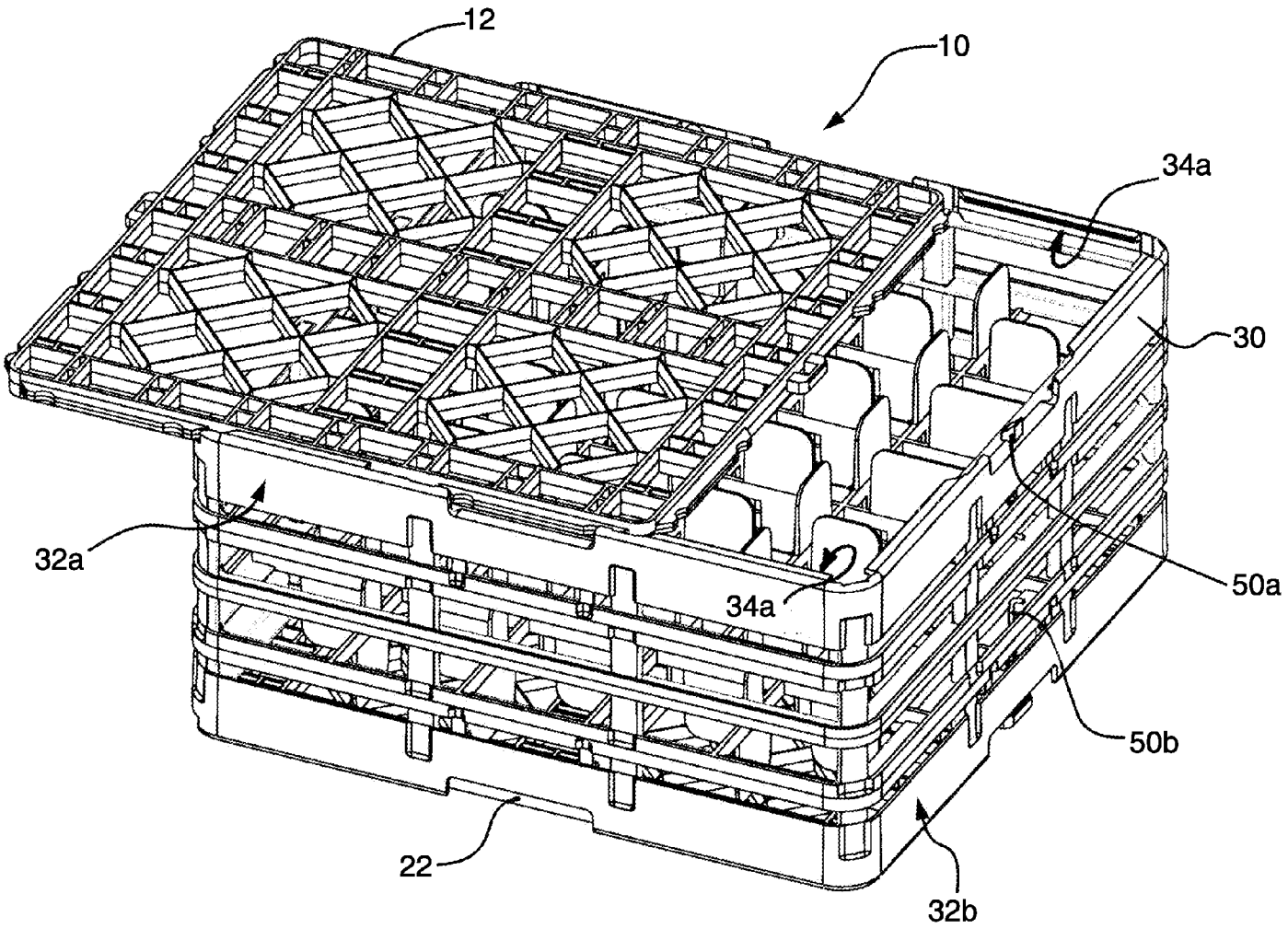
FIG. 1 is a perspective view of a preferred embodiment of a dish rack 10 of the present invention, wherein the preferred dish rack 10 has a top portion 12, a bottom portion 22 and a base portion 30 having parallel channels 34*a* on the upper part 32*a* of the base portion 30 to slidably engage the top portion 12 and an upper latch 50*a* to engage a catch 55*a* on the top portion 12; wherein respective edges 14*a* of the top portion 12 can slide within the channels 34*a* (opposing channel not visible)
Figure 2:
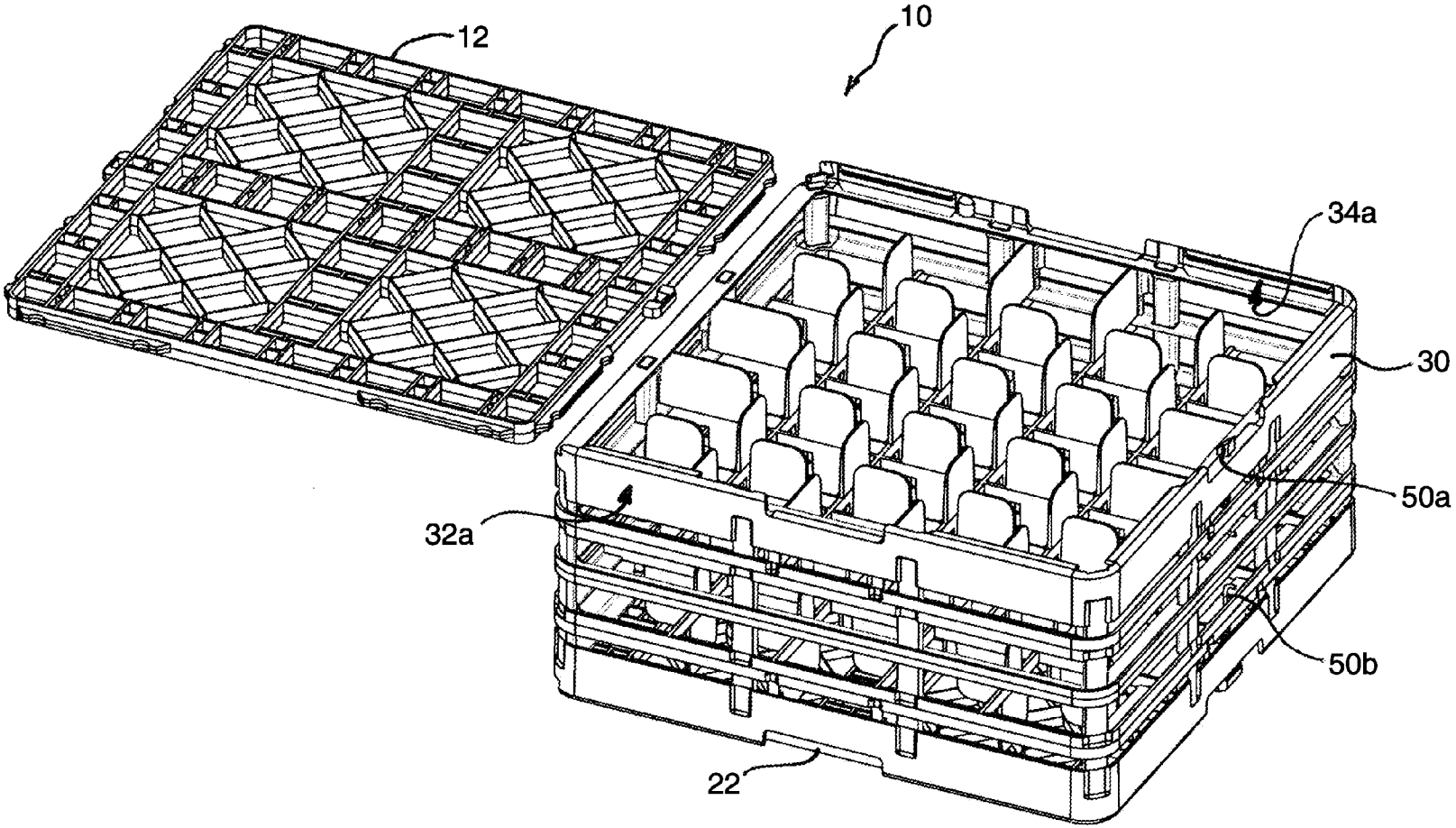
FIG. 2 is a perspective view of the dish rack 10 of FIG. 1, wherein the top portion 12 has been disconnected from the base portion 30.
Figure 3A:
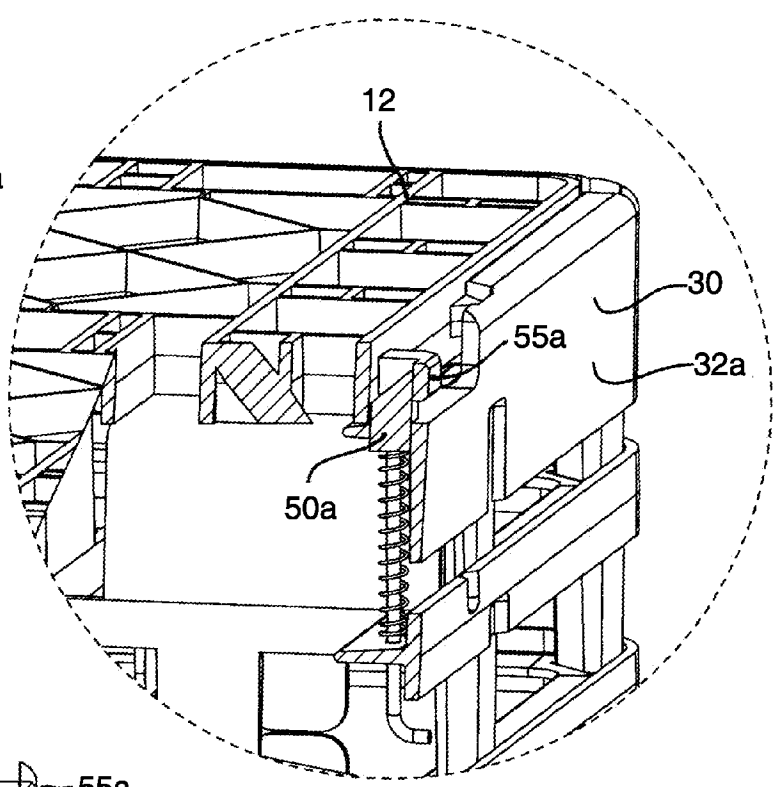
FIG. 3A is an enlarged view of the section 3A of FIG. 3 illustrating the latch 50*a* engaging the top portion 12 when the top portion 12 is in a latched position in which the catch 55*a* is engaged by the spring biased latch 50*a* so that the top portion 12 is unable to disengage from the latch 50*a* and the base portion 30.
Figure 3:
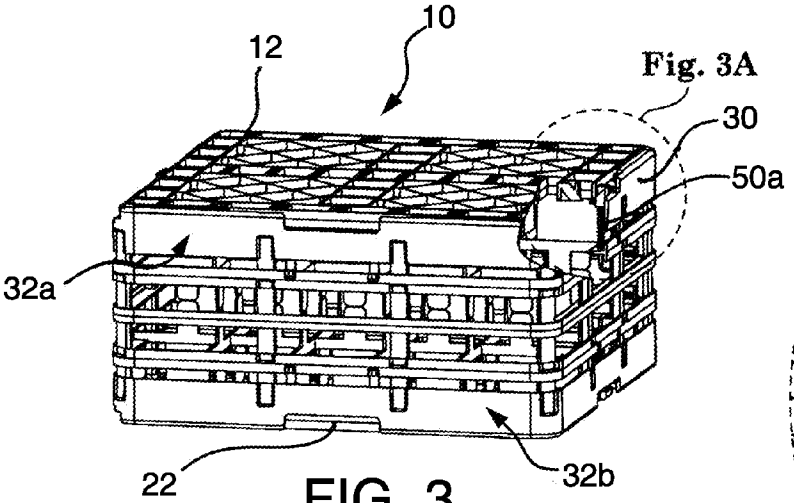
FIG. 3 is a partial perspective view of the dish rack 10 of FIGS. 1-2, wherein the top portion 12 is operatively secured to the base portion 30 in a latched position; wherein a section of the upper right side of the dish rack 10 has been removed for clarity to illustrate the latch 50*a;*
Figure 3C:
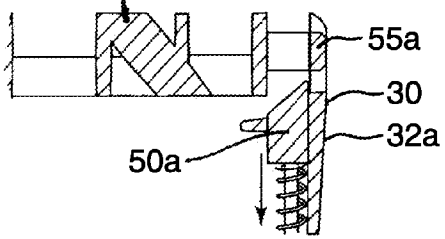
FIG. 3C is a perspective view of the dish rack 10 of FIGS. 1-3, similar to FIG. 3B, but showing the latch 50*a* in a depressed position that leaves the top portion 12 in the same position as shown in FIGS. 3 and 3A, but would allow the top portion 12 to slide away from the latch 50*a* if force was placed on the top portion 12 in the same direction as is indicated by the arrow, so that the top portion 12 can be disengaged both from the latch 50*a* and the channels 34*a* (see also, FIG. 2) in which the top portion 12 is engaged.
Figure 3B:
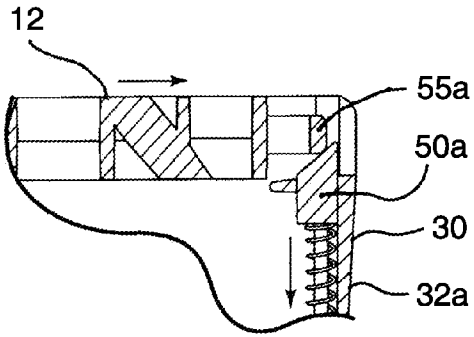
FIG. 3B is an enlarged, side sectional view similar to FIG. 3A, but from the side, except that the arrow above the top portion 12 is shown to indicate that the top portion 12 is moving toward the latched position as the top portion 12 is sliding in the respective channels 34*a* (as shown in FIG. 2) so as to depress the latch 50*a;*
Figure 4:
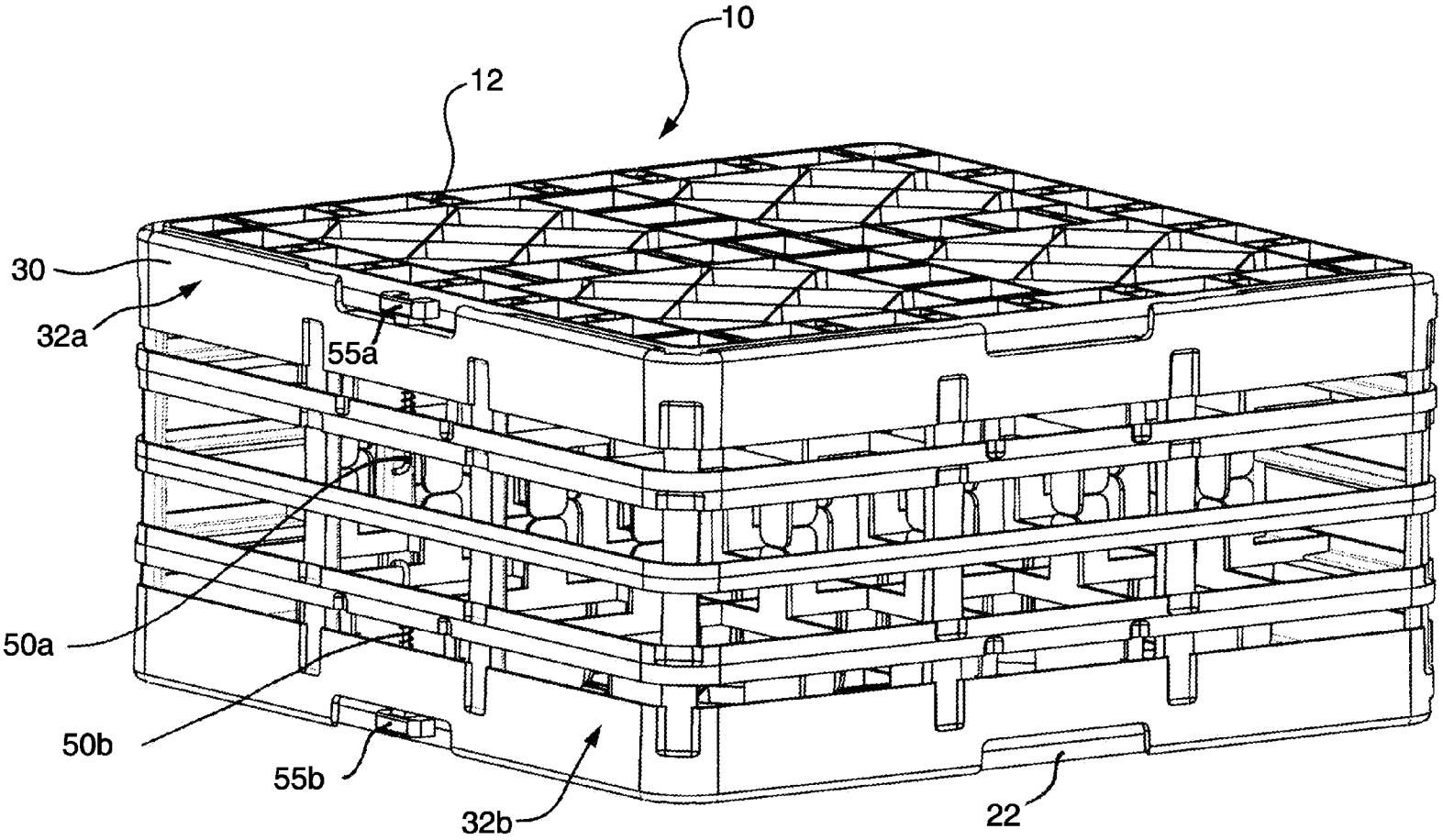
FIG. 4 is a further perspective view of the dish rack 10 of FIGS. 1-3C wherein the top portion 12 and the bottom portion 22 are operatively latched to the base portion 30 and engaged within the respective channels (not visible)
Figure 5:
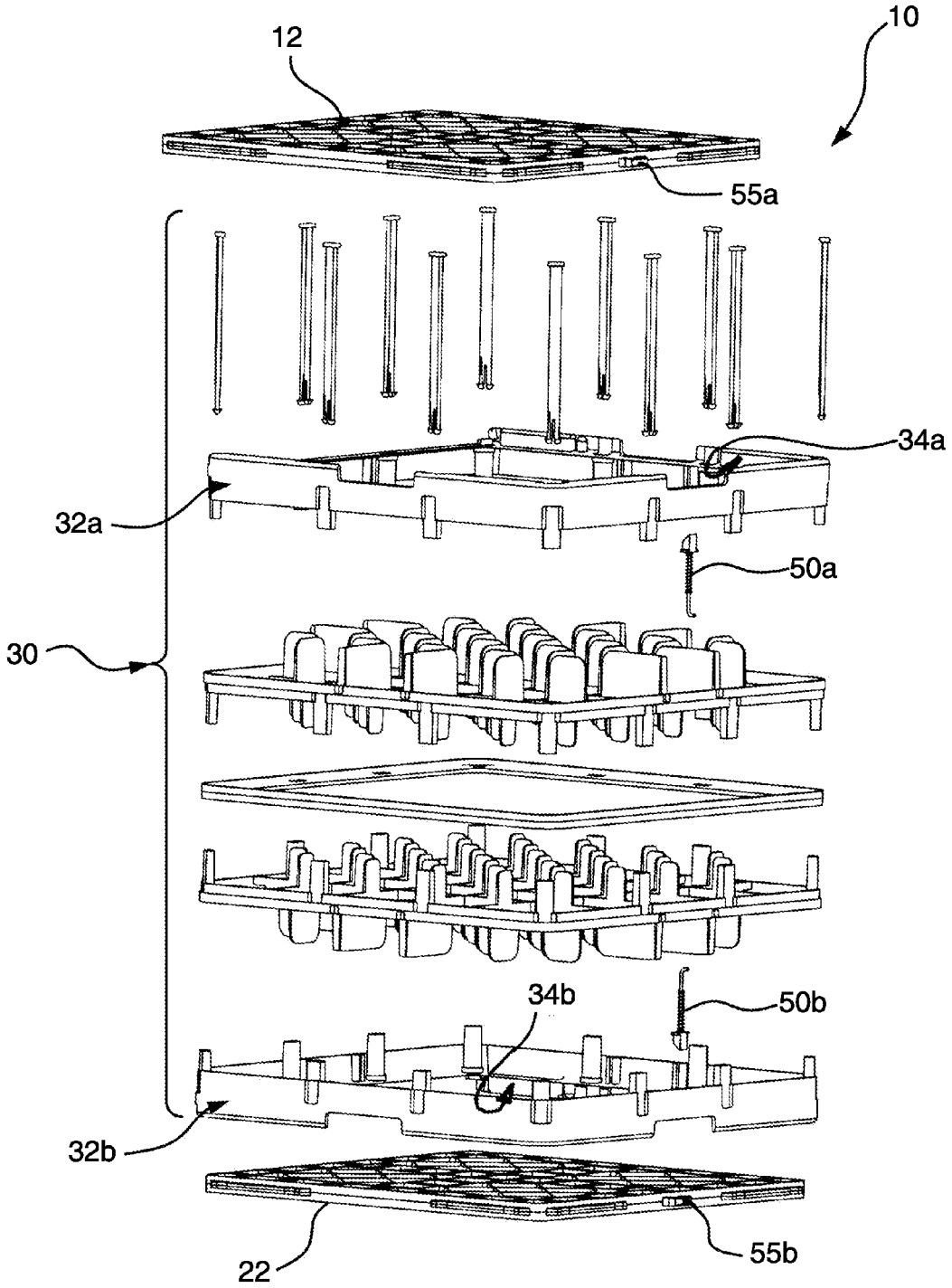
FIG. 5 is an exploded perspective view of the dish rack 10 shown in FIGS. 1-4; it will be appreciated that the bottom portion 22 is the same as the top portion 12, each of which is called a "pilot" in the discussion above, and that the base portion 30 includes a lower part 32*b* that has all of the same elements and features (not shown) of the upper part 32*a* that engage the top portion 12, but these elements and features of the lower part 32*b* are mirror images of the respective elements and features of the upper part 32*a;*

Dish rack 10 preferably includes dividers, 18, which separate the glassware or other dishwares within the dish rack 10. In FIG. 1, the top portion 12 is shown in the sliding position. The bottom portion 14, will generally be in place until the rack 10 is flipped over, then bottom portion 14 can be removed as needed. FIG. 1 is a perspective view of the dish rack 10, having a top portion 12, a bottom portion 22 and a base portion 30 having parallel channels 34*a*, 34*b* on the upper part 32*a* of the base portion to slidably engage the top portion 12 and an upper latch 50*a* to further secure the top portion 12. A lower latch 50*b* is preferably provided to secure the bottom portion 22 to the base portion 30. Preferably, respective edges 14*a*, 14*b* of the top portion 12 can slide within the channels 34*a*, 34*b* (and opposing channels not shown). FIG. 3 is a perspective, partial view of the dish rack 10 of FIGS. 1-2, wherein the top portion 12 is operatively secured to the base portion 30 in a latched or closed position. A section of the upper right side of the dish rack 10 has been removed for clarity to illustrate the latch 50. FIG. 3A is an enlarged view of the section 3A of FIG. 3 illustrating the latch 50 engaging the top portion 12 when the top portion 12 is in a latched position. FIG. 3B is an enlarged, side sectional view similar to FIG. 3A, but from the side, except that the arrow above the top portion 12 is shown to indicate that the top portion 12 is moving toward the latched position as the top portion 12 is sliding in the respective channels 34*a*, 34*b* (as shown in FIG. 2) so as to depress the latch 50. FIG. 3C is a perspective view of the dish rack 10 of FIGS. 1-3, similar to FIG. 3B, but showing the latch 50 in a depressed position that leaves the top portion 12 in the same position as shown in FIGS. 3 and 3A, but allows the top portion 12 to slide away from the latch 50 so that the top portion 12 can be disengaged both from the latch 50 and the channels 34*a*, 34*b* (see also, FIG. 2) in which the top portion 12 is engaged with the latch 50. FIG. 4 is a further perspective view of the dish rack 10 of FIGS. 1-3; wherein the top portion 12 and the bottom portion 22 are operatively latched to and engaged within the respective channels 34*a*, 34*b*. FIG. 5 is an exploded perspective view of the dish rack 10 shown in FIGS. 1-4. It will be appreciated that the bottom portion 22 is the same as the top portion 12 and that the base portion 30 includes a lower part 34 that has all of the same elements and features (not shown) of the upper part 32 that engage the top portion 12, but that these elements and features are mirror images of the respective elements and features of the upper part 32.

Figure 6:
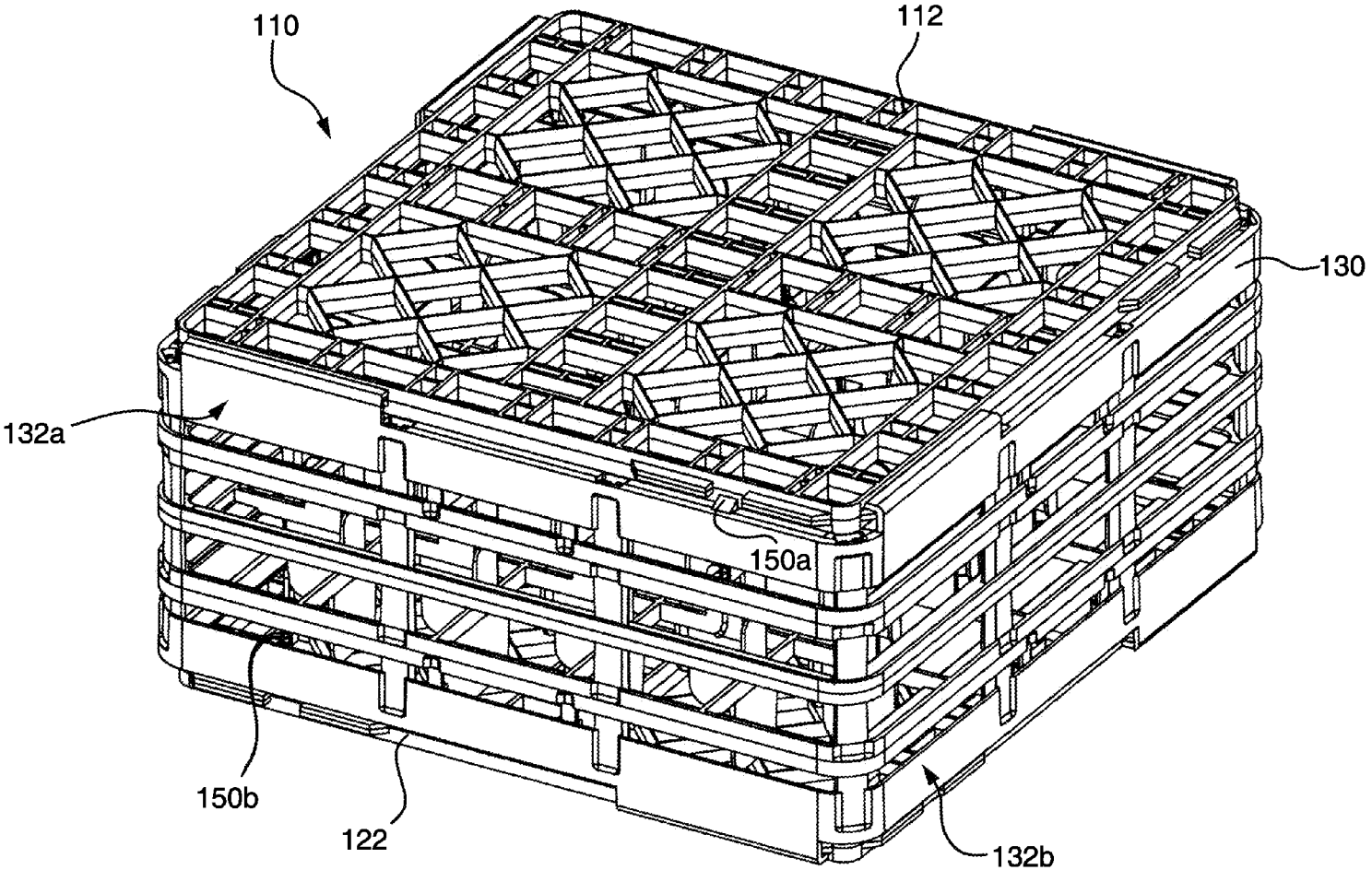
FIG. 6 is a perspective view of a second preferred disk rack 110 of the present invention the respective top and bottom pilots 112, 122 can be twisted with respect to the base portion 130 so as to disengage from or engage with the base portion 130; the preferred dish rack 110 having a top portion 112, a bottom portion 122 and a base portion 130; the base portion 130 having an upper latch 150*a* and a lower latch 150*b* (not visible), wherein the top pilot or top portion 112 and the bottom pilot or bottom portion 122 can be engaged with the base portion 130 by aligning the respective top portion 112 or bottom portion 122 with the base portion 130 such that the respective latch 150*a* (150*b* not shown) can prevent the respective top portion 112 or bottom portion 122 from disengaging from the base portion 130 when the respective latches 150*a* (150*b* not shown) are in a released position shown in FIG. 6.
Figure 7B:
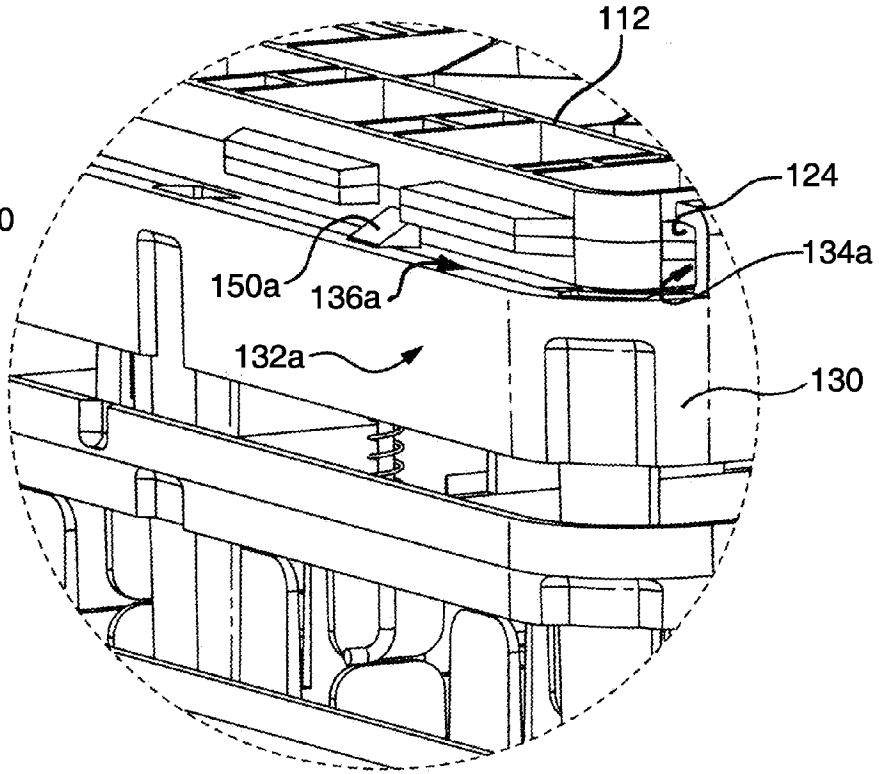
FIG. 7B is an enlarged perspective view of the dish rack 110 of FIG. 7A taken from the circle 7B and showing the upper latch 150*a* in the released position in which it prevents the top portion 112 from disengaging from the base portion 130.
Figure 7A:
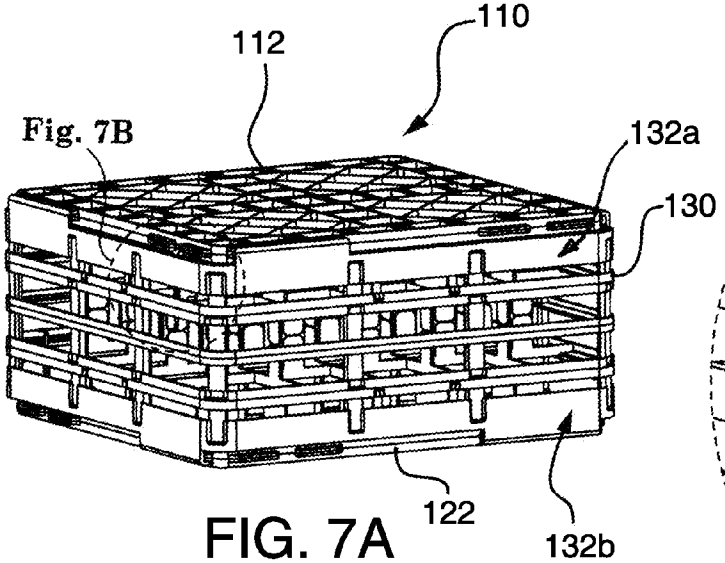
FIG. 7A is a perspective view of the disk rack 110 of FIG. 6 illustrating the top portion 112 and the bottom portion 122 fully engaged with the base portion 130 as shown in FIG. 6.
Figure 7C:
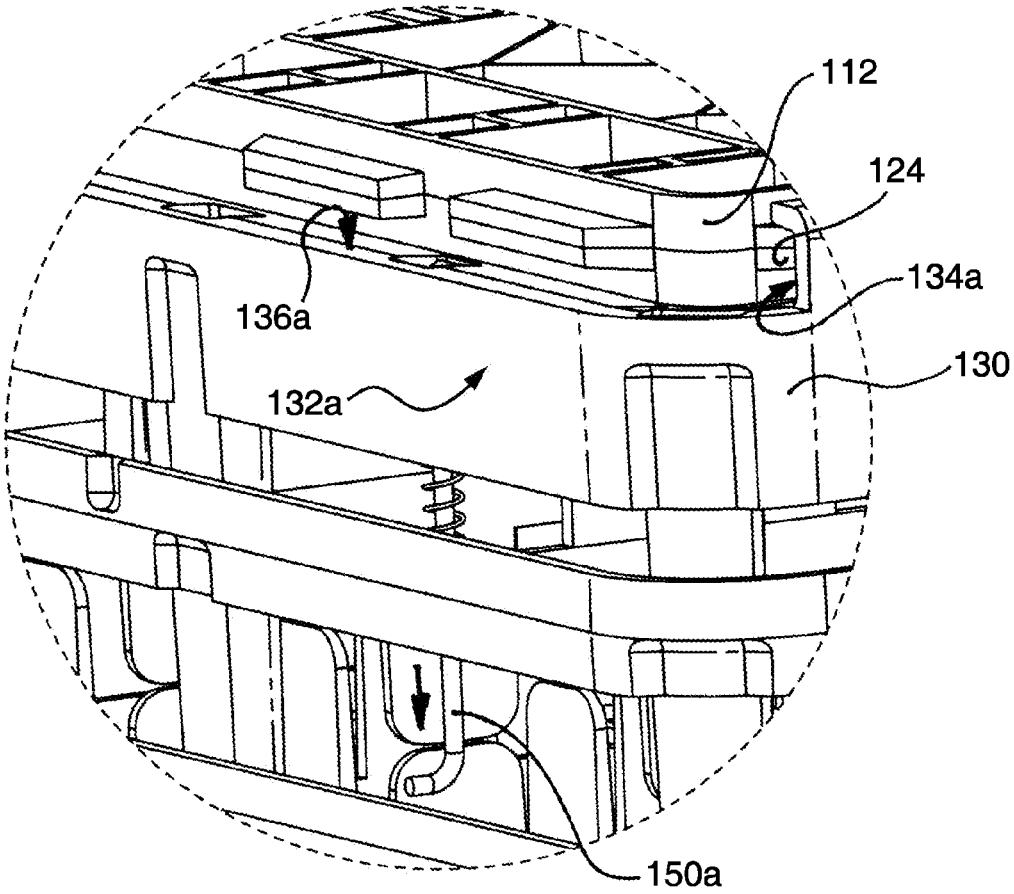
FIG. 7C is an enlarged perspective view similar to FIG. 7B, but showing the spring biased upper latch 150*a* in a depressed position that the spring biased latch 150*a* would occupy when force has been placed upon the spring biased upper latch 150*a* to hold the upper latch 150*a* in the depressed position that is shown; wherein the entire upper latch 150*a* is held below the upper surface 136 of the base portion 130, which would allow the top portion 112 to be turned or twisted sufficiently to partially disengage top portion 112 from the base portion 130 as shown in FIG. 7D.
Figure 7D:
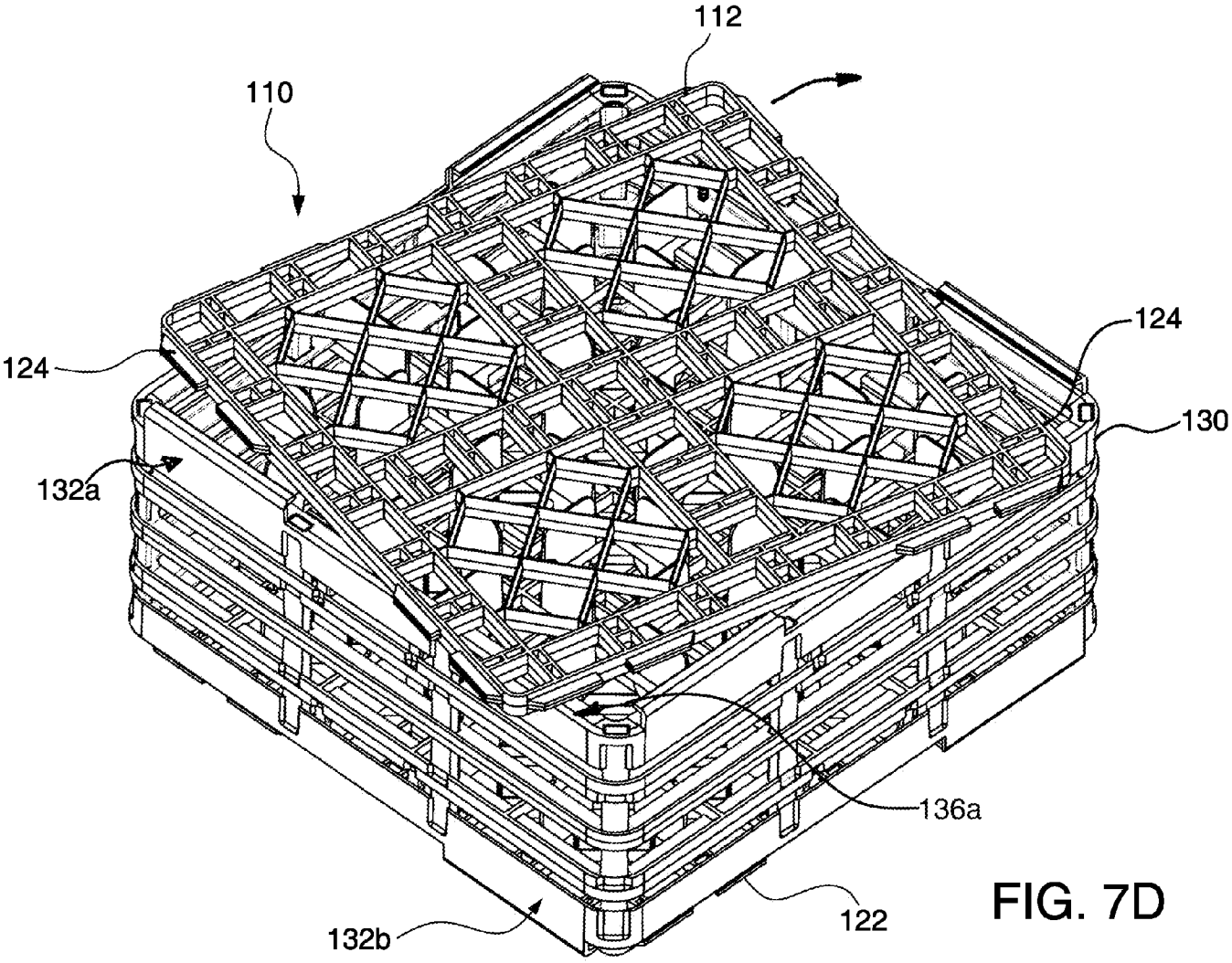
FIG. 7D is a perspective view of the dish rack 110 shown in FIGS. 7A-7C, but showing the top portion 112 being in a turned position with respect to the base portion 130 so that it is partially disengaged from the base portion 130 and can be just lifted off of the base portion 130 so as to be fully disengaged from the base portion 130; it will be appreciated that the upper portion 112 can be turned partially so as to reach the partially disengaged position that is shown, from the fully engaged position shown in FIG. 7A, only if the spring biased upper latch 150*a* is depressed as shown in FIG. 7C; it will be further appreciated that the bottom portion 122 can be partially disengaged from the base portion 130 in exactly the same manner and that both the top portion 112 and the bottom portion 122 can be lifted away from the base portion 130 and completely disengaged therefrom once either is in the partially disengaged position in which the top portion 112 is shown in FIG. 7D; and that either the top portion 112 or the bottom portion 122 can be reengaged with the base portion 130 from the partially disengaged position by turning or twisting the respective top or bottom portions 112, 122 with respect to the upper surface 136*a* or the lower surface (not shown) of the base portion 130, so as to reengage protruding edges 124 in channels 134*a* and 134*b* (not shown) to fully engage the respective top or bottom portion 112, 122 with the base portion 130 as shown in FIG. 7A.

FIG. 6 is a perspective view of a second preferred disk rack 110 of the present invention. The preferred dish rack 110 having a top portion 112, a bottom portion 122 and a base portion 130 having an upper latch 150*a* and a lower latch 150*b*, wherein the top portion 112 and the bottom 122 portion can be engaged with the base portion 130 by aligning the respective top portion 112 or bottom portion 120 with the base portion 130 such that the latch 150*a*, 150*b* can prevent the top portion 112 or bottom portion 120 from disengaging from the base portion 130 when the respective latches 150*a*, 150*b* are in a released position shown in FIG. 6. FIG. 7A is a perspective view of the disk rack 110 of FIG. 6 illustrating the top portion 112 and the bottom portion 122 fully engaged with the base portion 130 as shown in FIG. 6. FIG. 7B is an enlarged perspective view of the dish rack 110 of FIG. 7A taken from the circle 7B and showing the upper latch 150*a* in the released position in which it prevents the top portion 112 from disengaging from the base portion 130. FIG. 7C is an enlarged perspective view similar to FIG. 7B, but showing the spring biased upper latch 150*a* in a depressed position when force has been placed upon the spring biased upper latch 150*a* to hold the upper latch 150*a* in the depressed portion in which the entire upper latch 150*a* is below the upper surface 136 of the base portion 130. FIG. 7D is a perspective view of the dish rack 110 shown in FIGS. 7A-7C, but showing the top portion 112 being in a turned position so that it is partially disengaged from the base portion 130 and can be lifted off of the base portion 130 so as to be fully disengaged from the base portion 130. It will be appreciated that the upper portion 112 can be turned partially so as to reach the partially disengaged position shown, from the fully engaged position shown in FIG. 7A, only if the upper latch 150*a* is depressed as shown in FIG. 7C. It will further be appreciated that the bottom portion 122 can be partially disengaged from the base portion 130 in exactly the same manner and that both the top portion 112 and the bottom portion 122 can be lifted away from the base portion 130 and completely disengaged therefrom once either is in the partially disengaged position shown in FIG. 7D; and that either the top portion 112 or the bottom portion 122 can be reengaged with the base portion 130 from the partially disengaged position by turning the respective top or bottom portions 112, 114 with respect to the base portion 130 so as to reengage protruding edges 124 in channels 134*a*, 134*b* to fully engage the respective top or bottom portion 112, 122 with the base portion 130 as shown in FIG. 7A.

Figure 8:
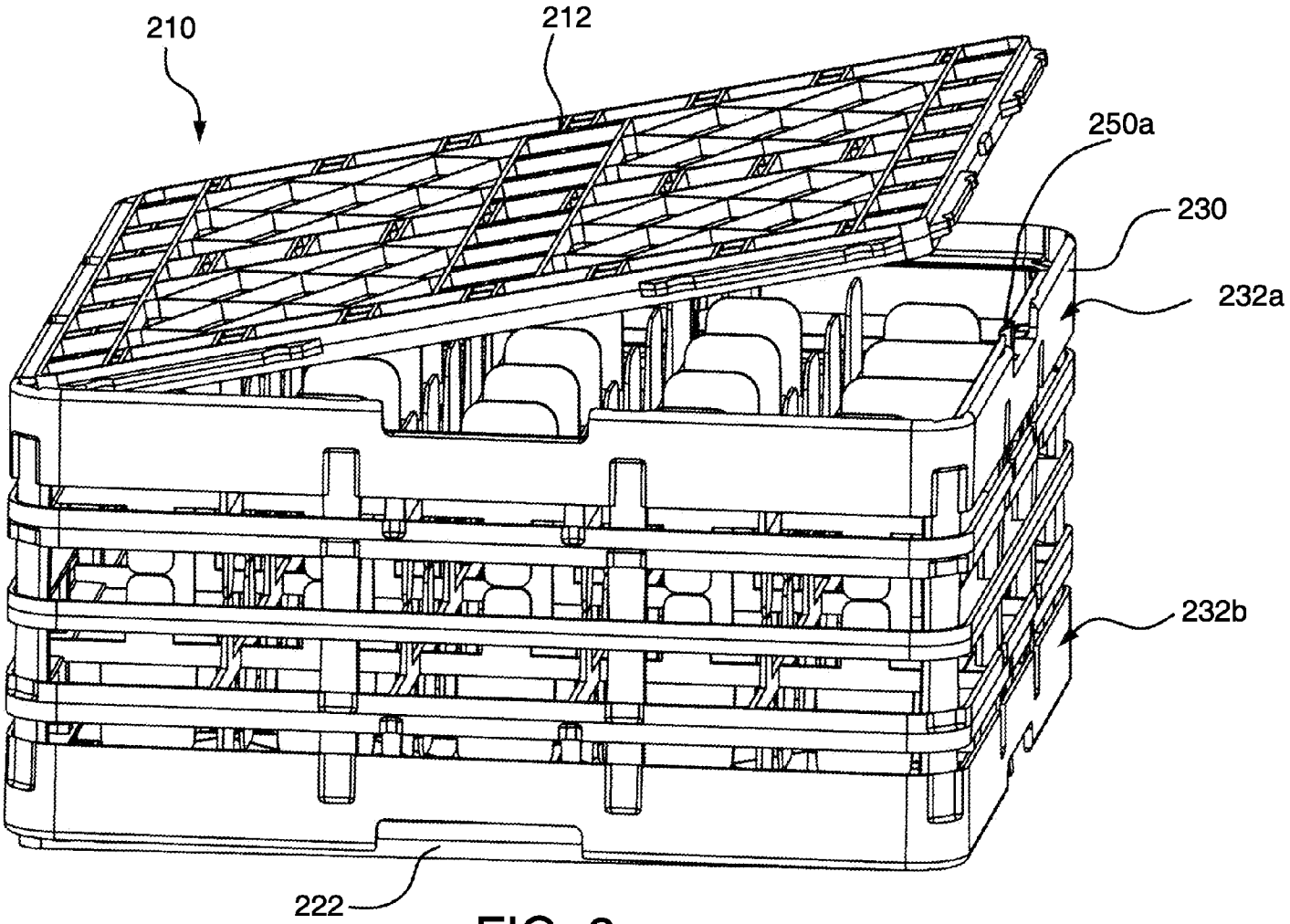
FIG. 8 is a perspective view of a third preferred embodiment of a dish rack 210 of the present invention; wherein the preferred dish rack 210 has both a top portion 212 and a bottom portion 222 and a base portion 230 having an upper latch 250*a* and a lower latch 250*b* (shown in FIG. 9A) that secure the respective top and bottom portions 212, 222 in place when an engaging lip 214 (see also FIG. 9A) on the respective top portion 212 is placed under or above respective upper or lower lips 234*a*, 234*b* and an opposite end of the respective top or bottom portion 212, 222 is secured to the base portion 230 by a spring biased latch 250*a*, 250*b* that engages the opposite side as shown in FIG. 9B; wherein the upper and lower pilots or portions 212, 222 can be disengaged from the base portion 230 when the respective arm 252*a*, 252*b* of the respective latch 250*a*, 250*b* is pressed toward the center of the base portion 230 against the spring biasing force of the respective latch as shown in FIG. 9C where the upper latch 250*a* is pressed toward the center of the base portion 230, so that the top portion 212 can be lifted up as shown in FIG. 8 with only the upper lip 234*a* obstructing the engaging lip 214 of the respective top portion 212 to create a hinge effect at that side of the base portion 230.

FIG. 8 is a perspective view of a third preferred embodiment of another dish rack 210 of the present invention. The preferred dish rack 210 has both a top portion 212 and a bottom portion 222 and a base portion 230 having an upper latch 250*a* and a lower latch 250*b* shown in FIG. 9A that respectively secures the respective top and bottom portions 212, 222 in place. To secure the dish rack 210 in the closed position, the upper or lower latches 250*a*, 250*b* are placed under the respective lip 214, 224 and one end of the respective top or bottom portion 212, 220 is secured to the base portion 230 by an upper lip 234*a* on the upper lip 232*a* of the base portion 230 and by a lower lip 234*b* on the lower part 232*b* of a corresponding side of the respective top or bottom portion 212, 222. A spring biased latch 250*a*, 250*b* engages the opposite side as shown in FIG. 9B. To release the top and bottom portions 212, 222, the arm 252*a*, 252*b* of the respective latch 250*a*, 250*b* is pressed toward the center of the base portion 230, against the spring biasing force of the upper latch 250*a*, as shown in FIG. 9C where the upper latch 250*a* is pressed toward the center of the base portion 230 so that the top portion 212 will be released so it can be lifted up as shown in FIG. 8 with the upper lip 232*a* obstructing a protruding edge 214, 224 of the respective top or bottom portion to create a hinge effect at that side of the base portion 230.

Figure 9A:
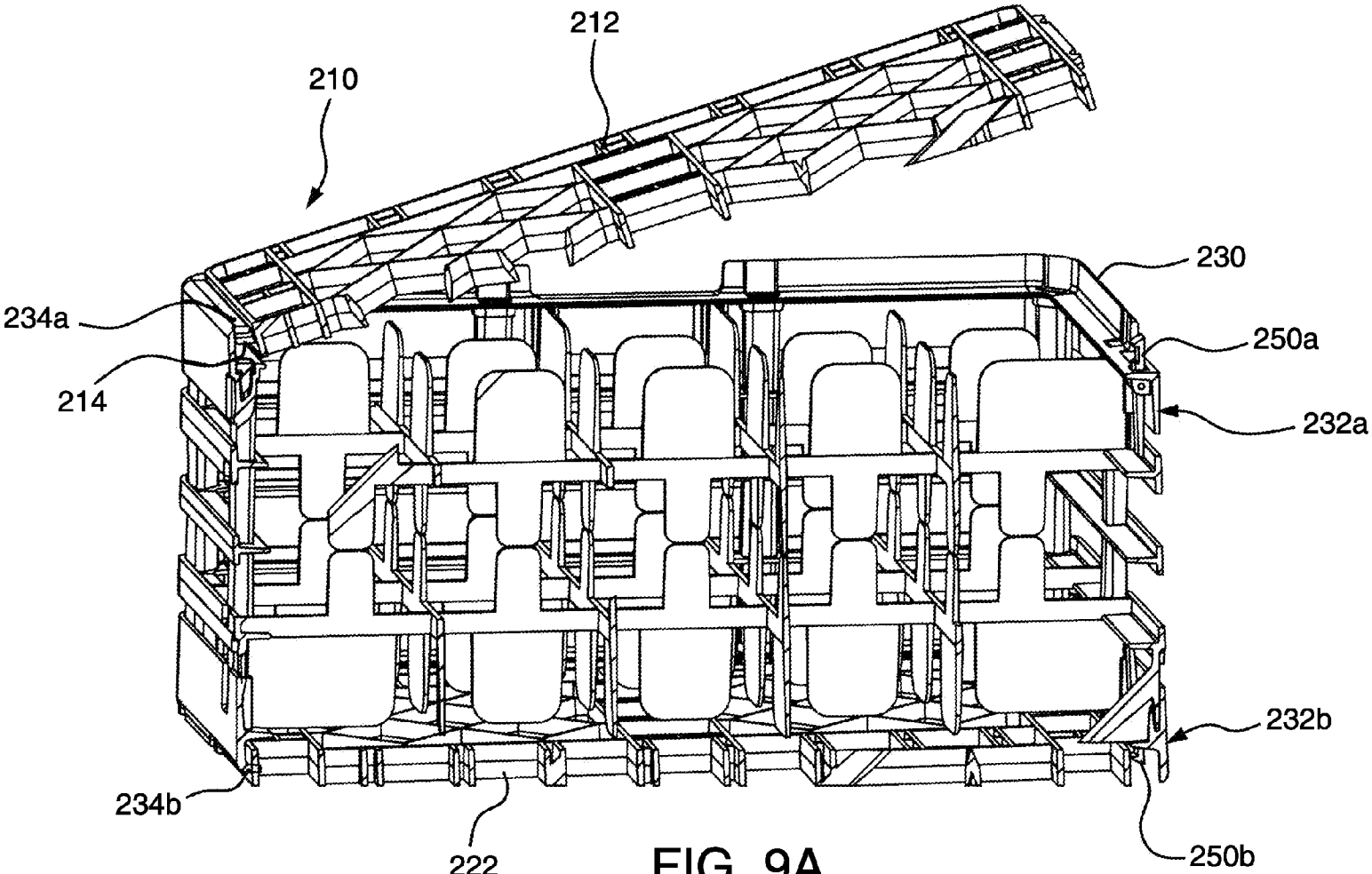
FIG. 9A is a partial cross sectional perspective view of the dish rack 210 of FIG. 8 illustrating the upper latch 250*a* in greater detail, wherein the upper latch 250*a* is arranged and configured to pivot in and out of position to engage the top portion 212, as desired.
Figure 9C:
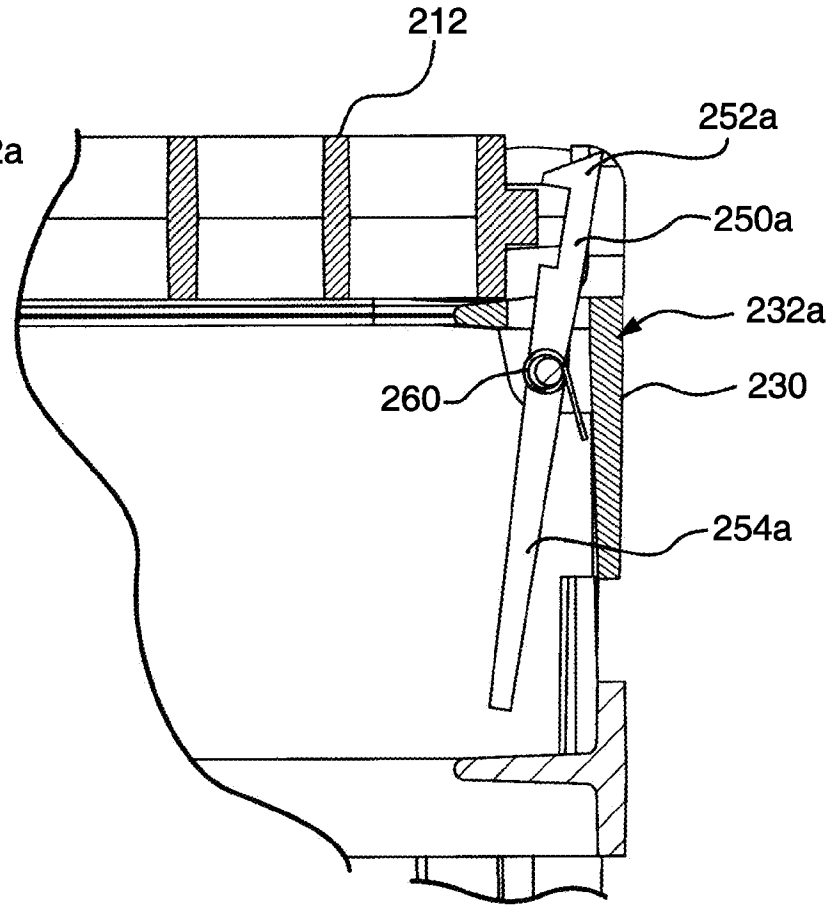
FIG. 9C is an enlarged partial cross-sectional side view similar to FIG. 9B, but showing the upper latch 250*a* in a disengaged position where the lower arm or lever arm 254*a* of the upper latch 250*a* is pushed inward toward the center of the base portion 230 against the biasing force of spring 260, so that the top 252*a* of the upper latch 250*a* compresses the spring 260, so that the top 252*a* of the upper latch 250*a* moves away from and disengages from the top portion 212, freeing it to be lifted and disengaged from the base portion 230.
Figure 9B:
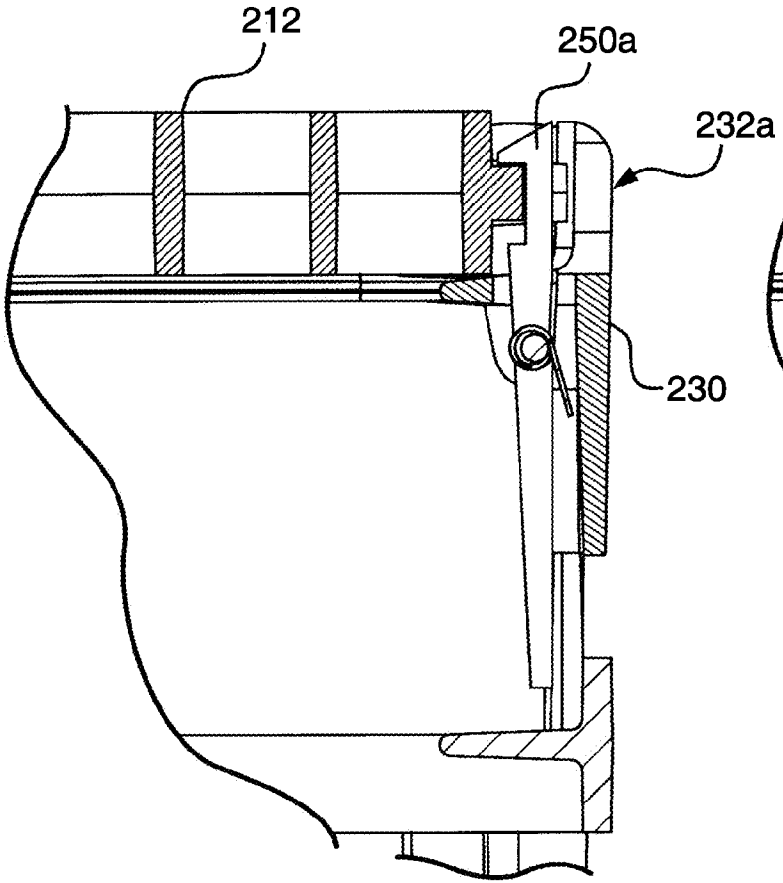
FIG. 9B is an enlarged partial cross-sectional side view of the cross section shown in FIG. 9A, but showing a part of the top portion 212 from the side and in a fully engaged position where the top portion 212 is secured to the base portion 230 and the spring biased upper latch 250*a* is in a released position in which the top portion 212 is held in place by the latch 250*a;*

FIG. 9A is a partial cross-sectional view of the dish rack 210 of FIG. 8 illustrating the latch 250*a* in greater detail, wherein the upper latch 250*a* is arranged and configured to pivot in and out of position to engage the top portion 212, as desired. FIG. 9B is a partial, side view of the cross section shown in FIG. 9A, but showing the top portion 212 in a full engaged position where the top portion 212 is secured to the base portion 230. FIG. 9C is partial side view similar to FIG. 9B, but showing the upper latch 250*a* in a disengaged position where the lower arm or lever arm 252*a* of the upper latch 250*a* is pushed inward toward the center of the base portion 230 against the biasing force of spring 260, so that the top 254*a* of the upper latch 250*a* compresses the spring 260, so that the top 254*a* of the upper latch 250*a* moves away from and disengages from the top portion 212, freeing it to be lifted and disengaged form the base portion 230.

Figure 10:
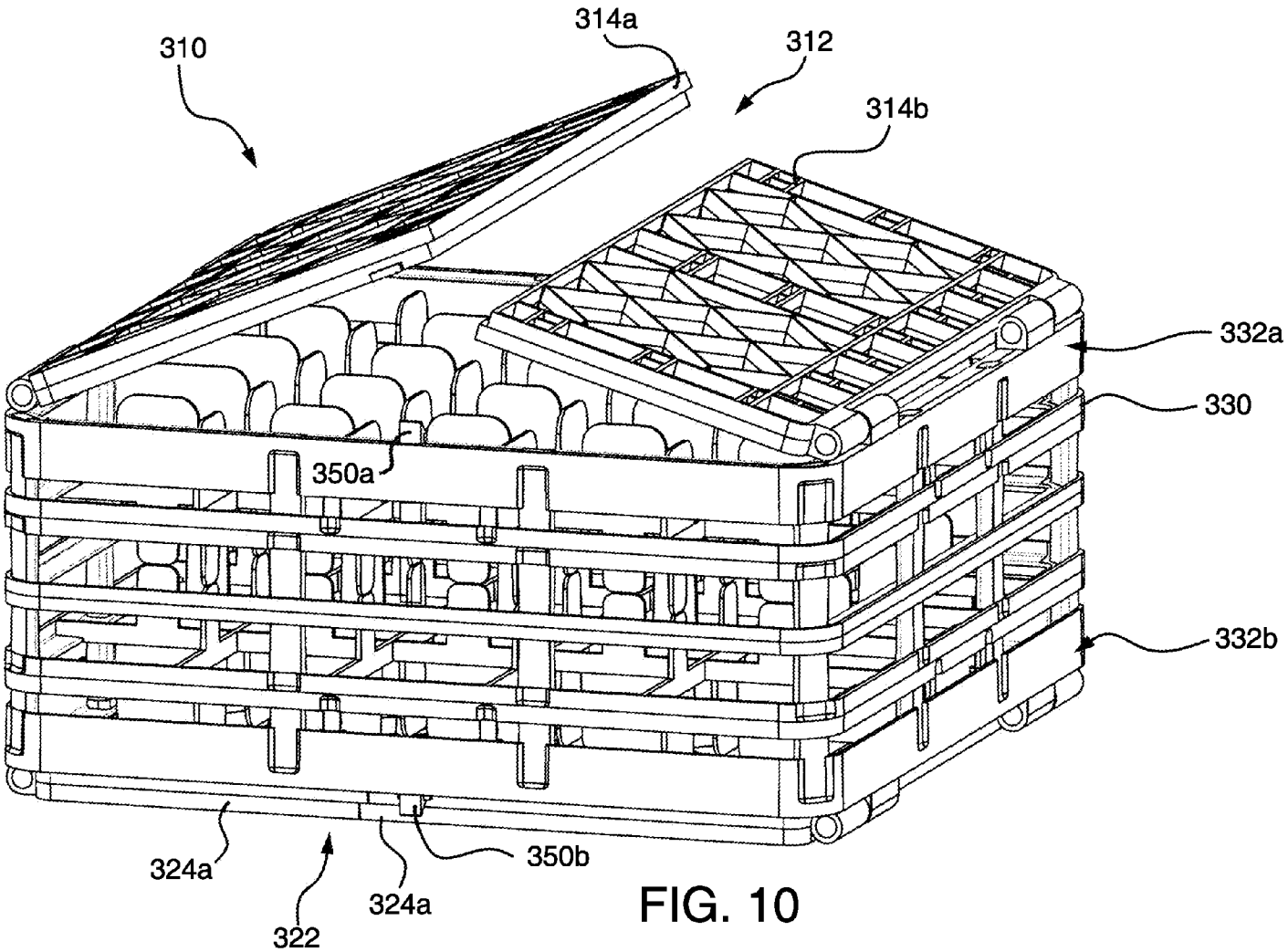
FIG. 10 is a perspective view of a fourth embodiment of a dish rack 310 of the present invention; the preferred dish rack 310 having a top portion 312 having first and second sections 314*a*, 314*b* that are each pivotally connected to a top part 332*a* of a base portion 330 and a bottom portion 320, also having first and second sections 324*a*, 324*b* each pivotally connected to a bottom part 332*b* of the base portion 330; the base portion 330 having separate spring biased latches 350*a*, 350*b* to engage the first section 314*a*, 324*a*, respectively, of the top and bottom portions 312, 322, to secure the top portion 312 and the bottom portion 322 to the base portion 330 as shown in FIG. 12A.
Figure 11:
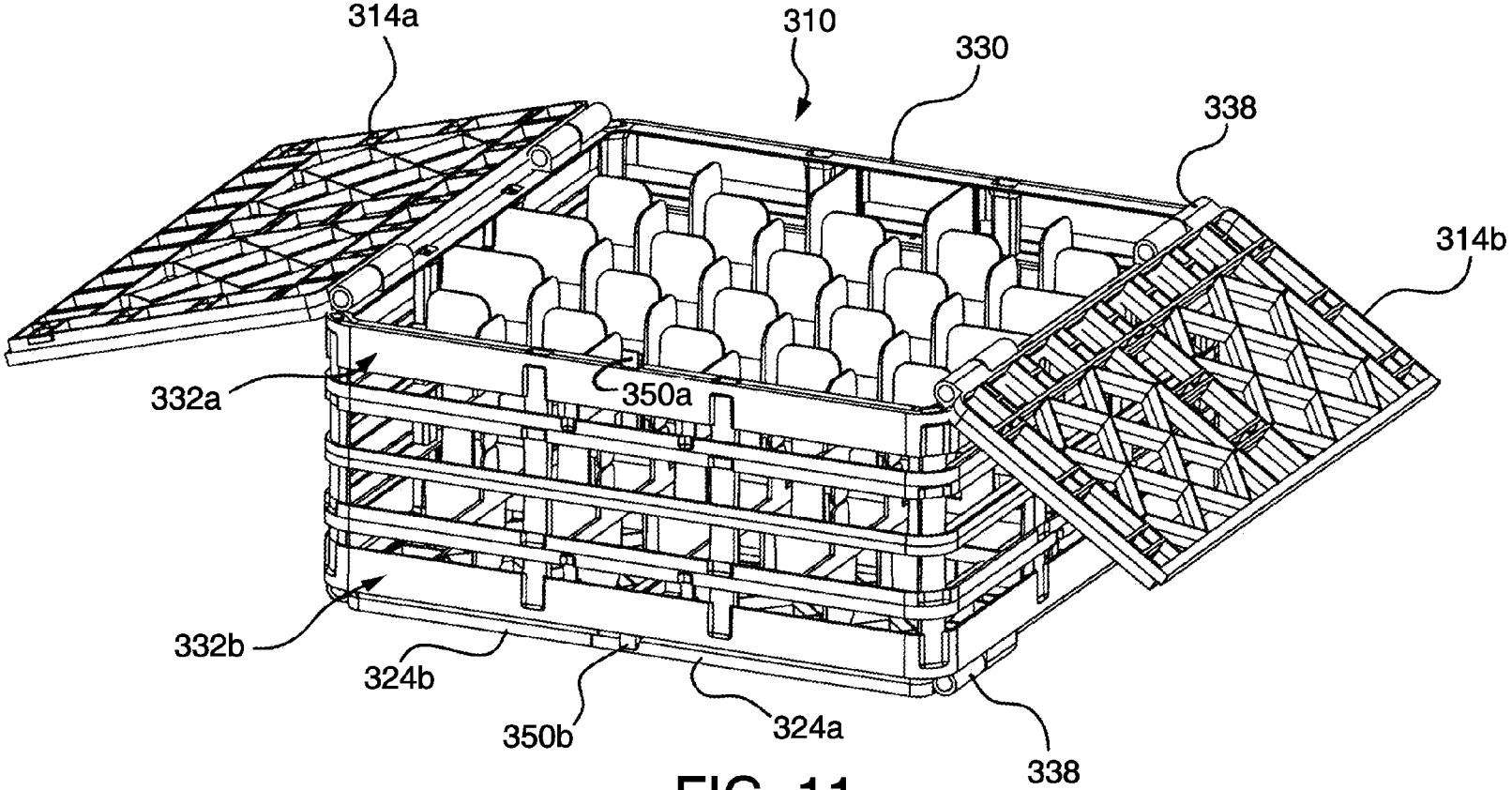
FIG. 11 is a perspective view of the dish rack 310 of FIG. 10 illustrating the respective sections 314*a*, 314*b* of the top portion 312 in a fully open position.
Figure 12B:
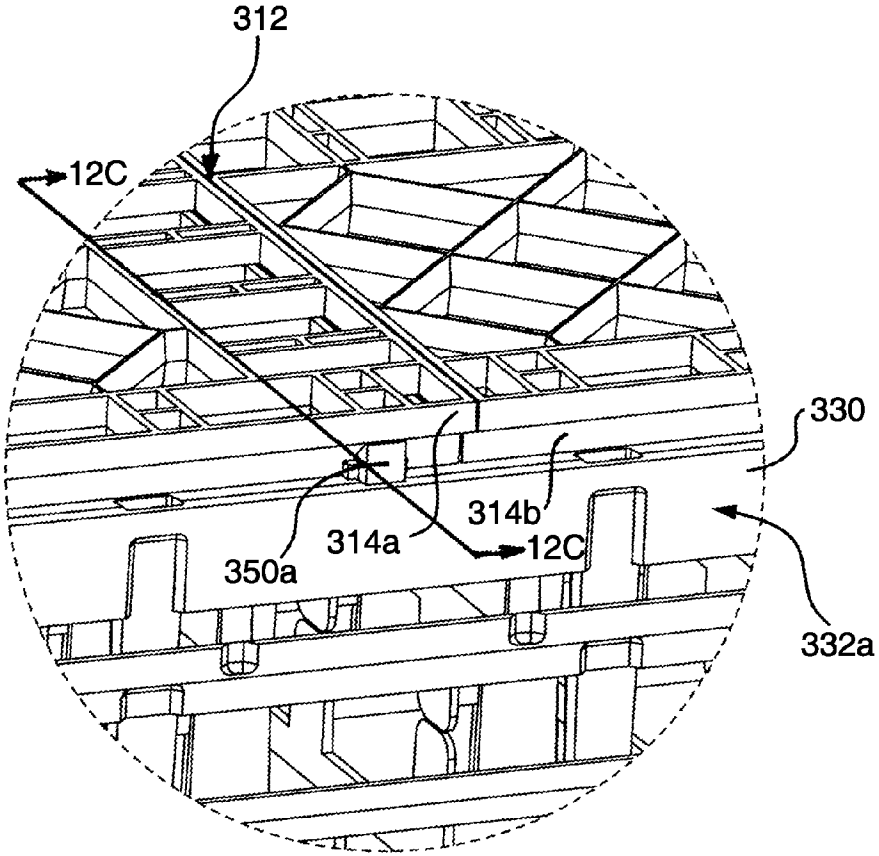
FIG. 12B is an enlarged perspective view of section 12B of FIG. 12A, illustrating the spring biased upper latch 350*a* engaging a catch 316 on the side of the first section 314*a* of the top portion 312, which holds the first section 314*a* in place against the base portion 330, as the first section 314*a* in turn, holds the second section 314*b* in place in the closed position against the upper part 332*a* of the base portion 330 as shown in FIG. 12A, because the upper lip 318*a* on the inside of the first section 314*a* holds the lower lip 318*b* on the inside of the second section 314*b* in place when both sections 314*a*, 314*b* are in the closed position against the upper part 332*a* of the base portion 330 as shown.
Figure 12A:
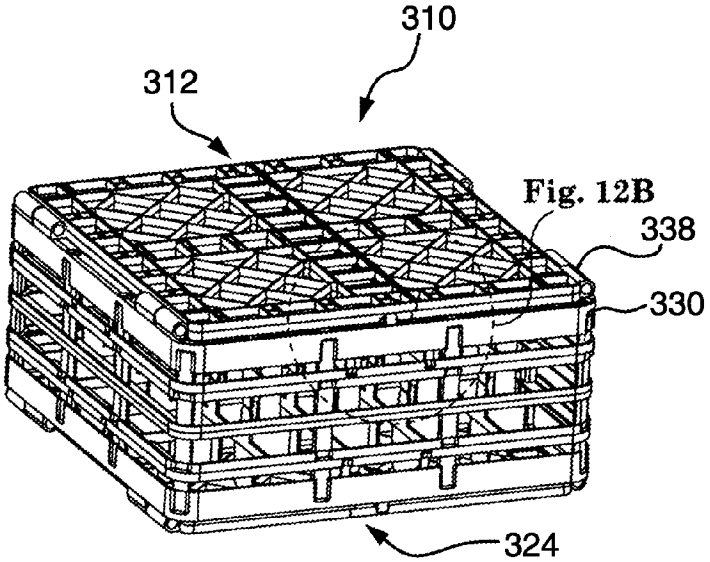
FIG. 12A is a perspective view of the dish rack 310 of FIGS. 10-11 when the first and second sections 314*a*, 314*b* of the top portion 312 and the first and second sections 324*a*, 324*b* of the bottom portion 322 are in closed positions; wherein each of the respective first and second sections 314*a*, 324*a*, 314*b*, 324*b*, respectively, of both the top and bottom portions 312, 322 are pivotally connected to the base portion 330 by hinges 338.
Figure 12D:
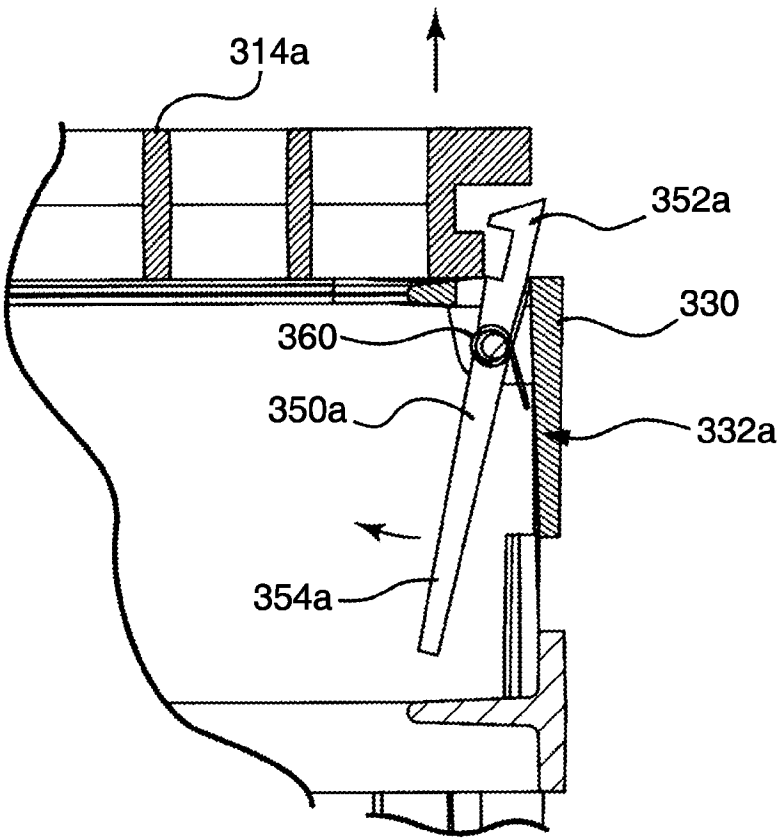
FIG. 12D is an enlarged cross-sectional side view similar to that of FIG. 12C, but illustrating the spring biased latch 350*a* pivoted from the released position shown in FIG. 12C into a disengaged position where force is required to hold the spring biased latch 350*a* in such a position such that sections 314*a* of the top portion 312 can be lifted upwardly so that the respective sections 314*a*, 314*b* can pivot in to the partially open and fully open positions shown in FIGS. 10 and 11, respectively.
Figure 12C:
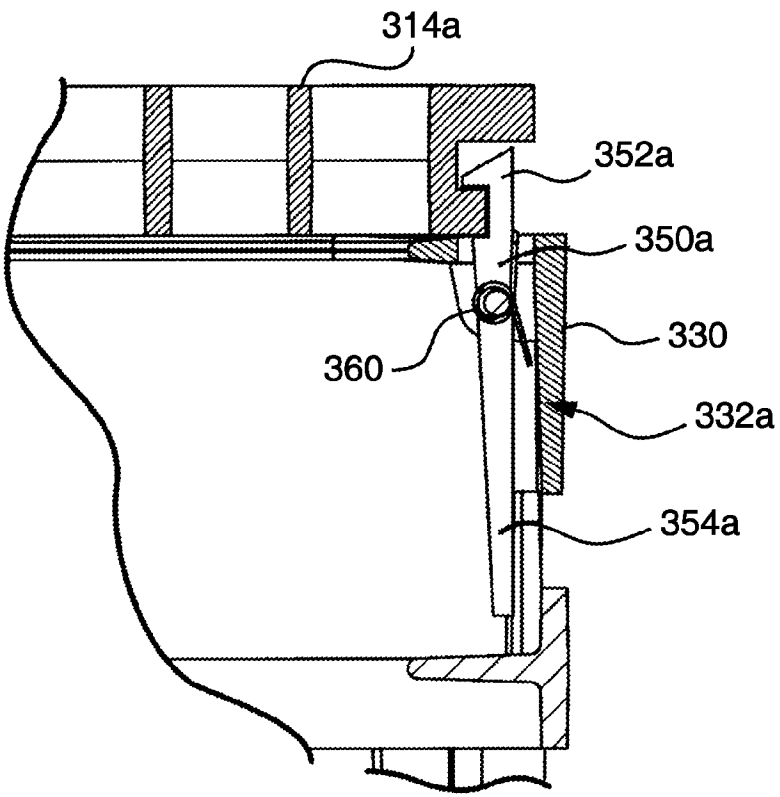
FIG. 12C is an enlarged cross-sectional side view of a portion of the dish rack 310 shown in FIGS. 12A-12B, as viewed shown from line 12C-12C of FIG. 12B, but where portions of the base portion 330 and the first section 314*a* are removed so that the spring biased latch 350*a* is visible from the side; wherein the latch 350*a* is shown in a released position in which the spring biased latch 350*a* holds the top portion 312 in place.

FIG. 10 is a perspective view of a fourth preferred embodiment of a dish rack 310 of the present invention. The preferred dish rack 310 has a bottom portion 320, a top portion 312 having first and second sections 314*a*, 314*b* that are pivotally connected to a base portion 330 having a separate lower latch 350*a* to engage the first section 314*a* of each of the top and bottom portions 312, 320, wherein the sections 314*a*, 314*b* of the top portion 312 can be secured to the base portion 330 with the lower latch 350*a*. FIG. 11 is a perspective view of the dish rack 310 of FIG. 10 illustrating the respective sections 314*a*, 314*b* of the top portion 312 in an open position. FIG. 12A is a perspective view of the dish rack 310 of FIGS. 10-11A. FIG. 12B is an enlarged view of the section 12B of FIG. 12A illustrating the upper latch 350*a* engaging a catch 316 on the side of the first section 314*a* of the top portion 312, which holds the first section 314*a* in place, as the first section 314*a* in turn, holds the second section 314*b* in place in the closed position because the upper lip 318*a* on the inside of the one section 314*b* holds the lower lip 318*b* on the inside of the other section 314*a* in place when both sections 314*a*, 314*b* are in the closed position.

Figure 13:
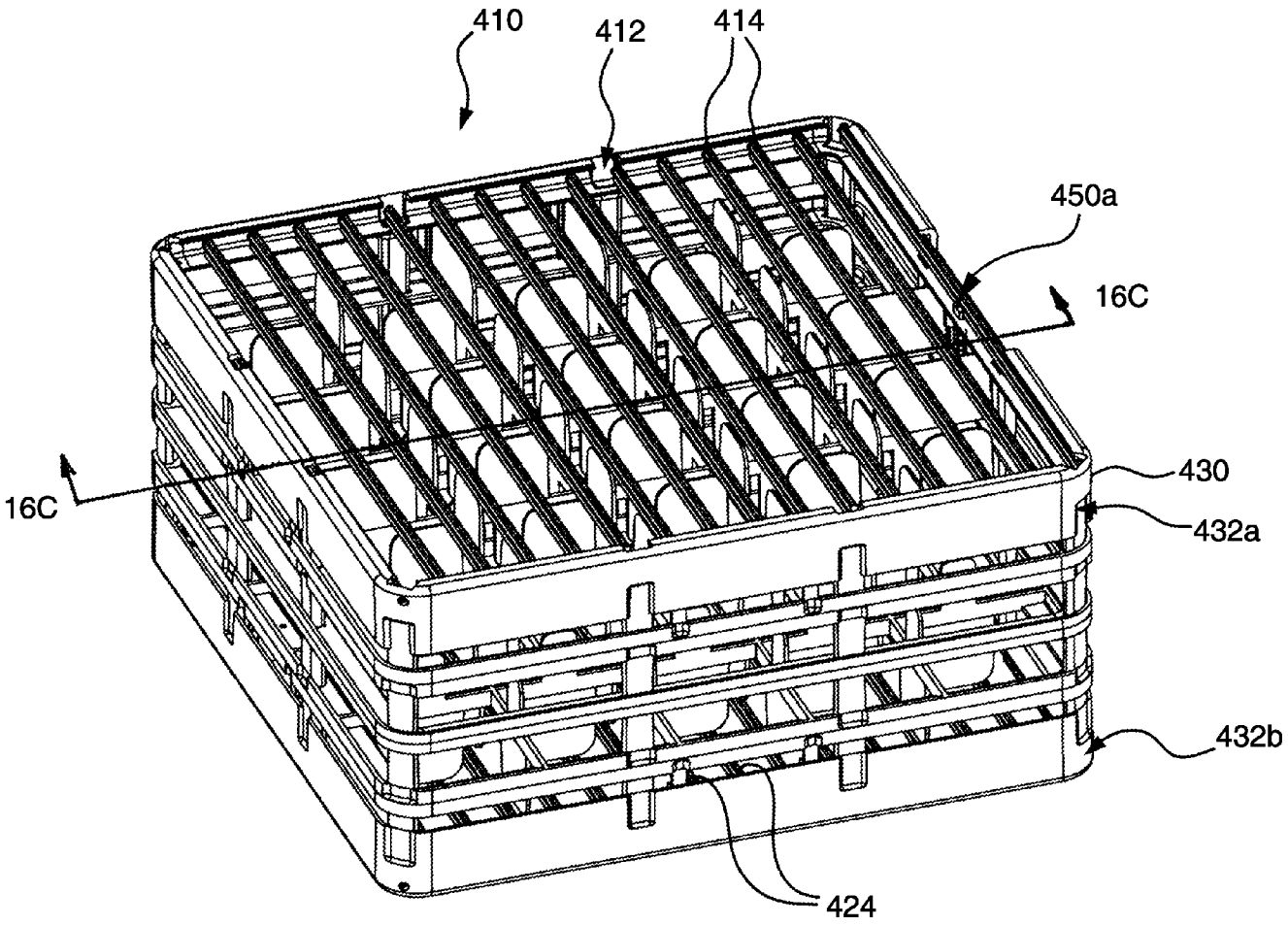
FIG. 13 is a perspective view of a fifth embodiment of a dish rack 410 of the present invention; the dish rack 410 having a top portion 412, a bottom portion 422 and a base portion 430 having a first spring biased latch 450*a* in an upper part 432*a* and a second spring biased latch (not shown), that operates in a like manner corresponding with the manner in which the first latch operates, but in a bottom part 432*b* of the base portion 430; wherein the top portion 412 and the bottom portion 422 include a plurality of rails 414, 424, respectively, that slide within opposing channels 434 on opposing sides of the respective upper part and lower part 432*a*, 432*b* of the base portion 430 and are spaced apart along a flexible member or other mechanism (not shown) to which the respective rails 414, 424 are secured; wherein the respective rails 414, 424 of the top portion 412 and the bottom portion 422 are slideable within the opposing channels 434 and are each secured in closed position, as shown, within the base portion 430 when corresponding spring biased latches 450*a*, 450*b* engages and holds the most proximate rail in the position shown in FIG. 13.
Figure 14:
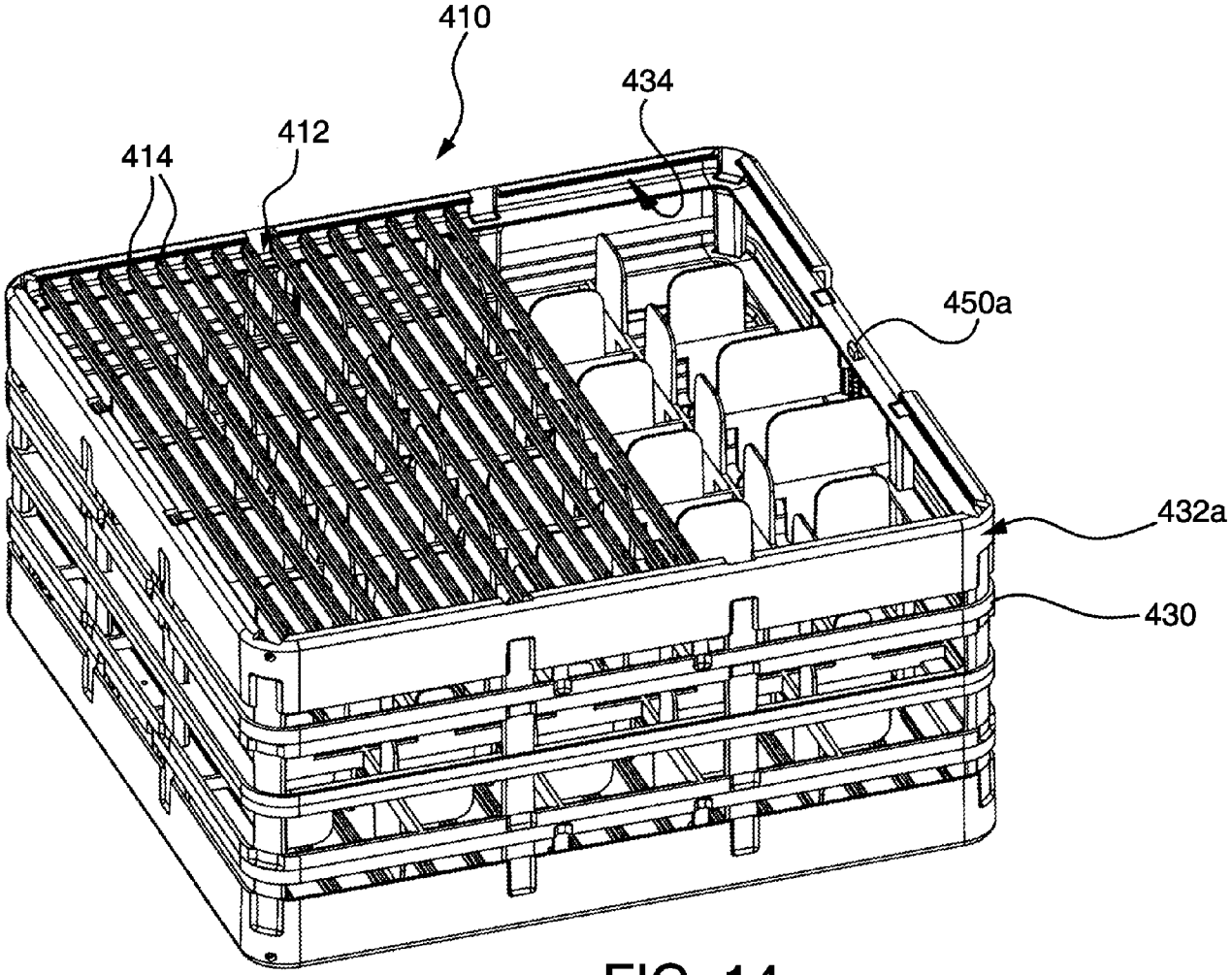
FIG. 14 is a perspective view of the dish rack 410 of FIG. 13 illustrating the rails 414 of the top portion 412 repositioned within the respective channels 434 to provide partial access to the interior of the dish rack 410.
Figure 15:
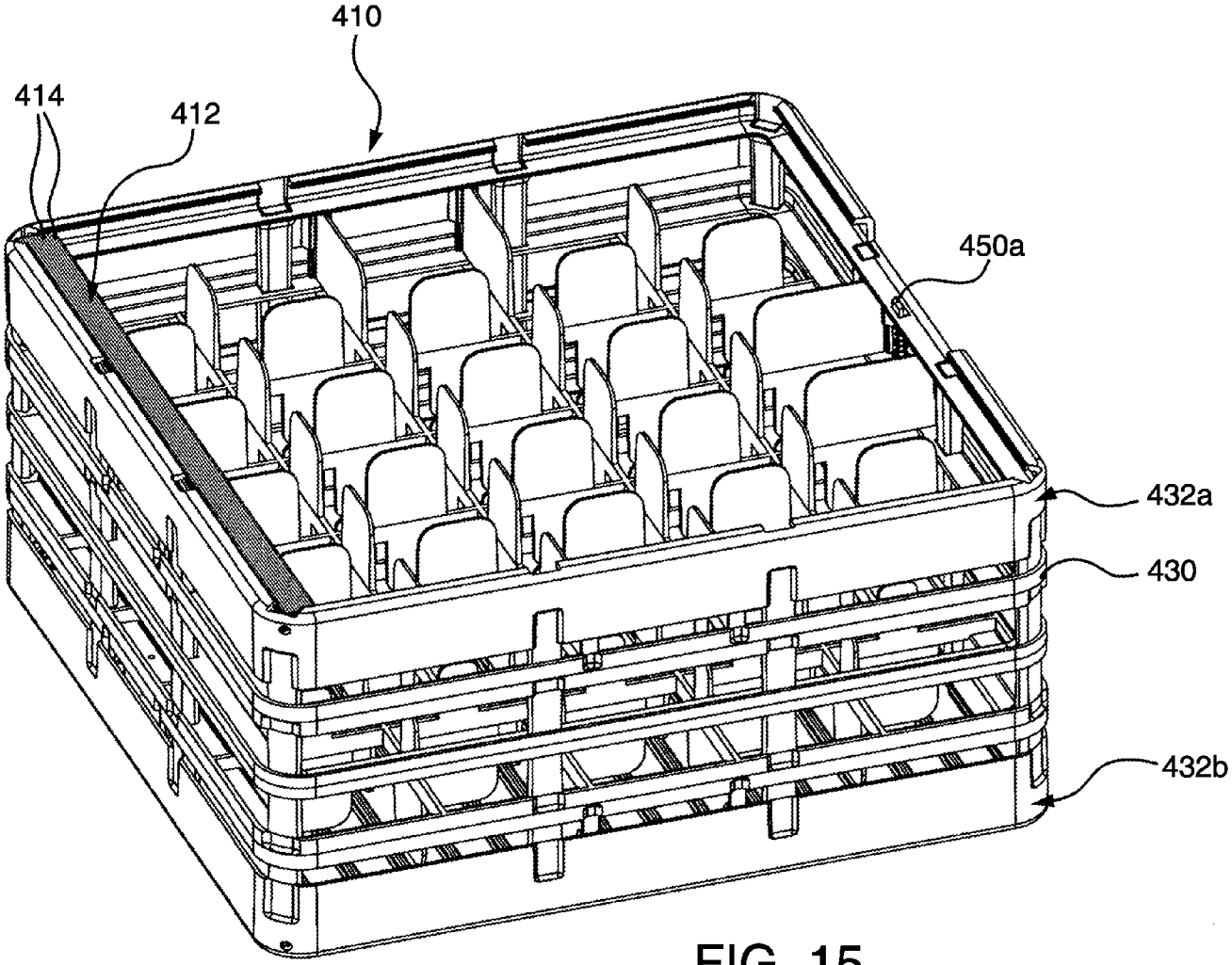
FIG. 15 is a perspective view of the dish rack 410 of FIGS. 13-14 illustrating the top portion 412 in a fully open position or orientation, wherein all of the rails 414 are collected at one end of the dish rack 410 such that dishwares (not shown) can be placed within the dish rack 410 and accessed and removed therefrom.
Figure 16B:
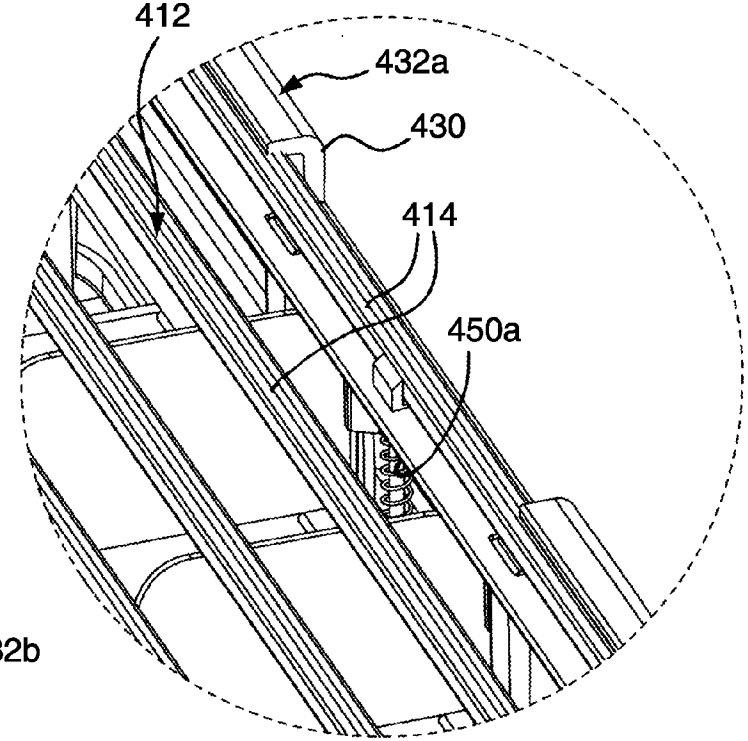
FIG. 16B is an enlarged perspective view of the dish rack 410 of section 16B of FIG. 16A illustrating the spring biased top latch 450*a* engaging a rail of the top portion 412 to secure the top portion 412 in the closed position shown in FIGS. 13 and 16.
Figure 16A:
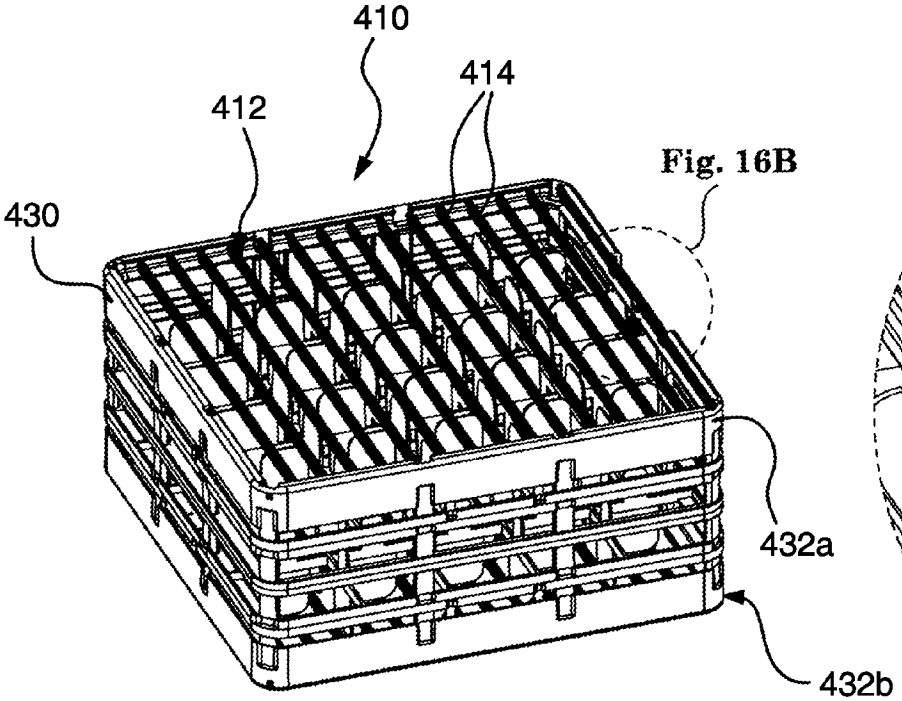
FIG. 16A is a perspective view of the dish rack 410 of FIGS. 13-15 similar to FIG. 13, illustrating the top portion 412 in a latched or closed position; wherein the spring biased top latch 450*a* engages a rail of the top portion 412 so that the top portion 412 is secured in the closed position.
Figure 16D:
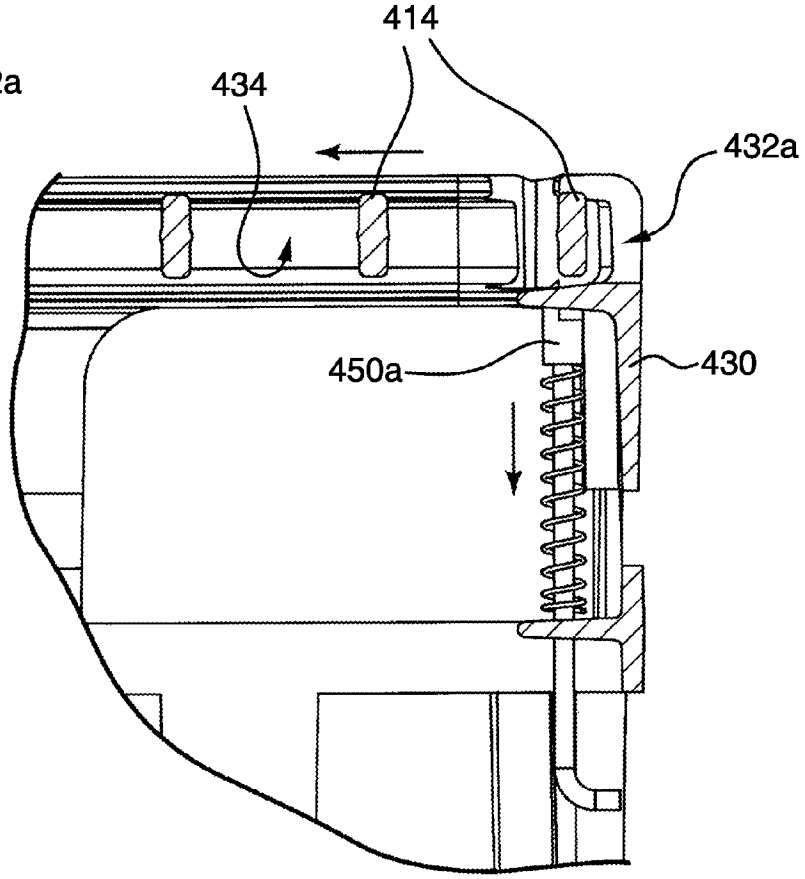
FIG. 16D is a view similar to that of FIG. 16C, illustrating the spring biased top latch 450*a* in a depressed disengaged position; wherein the spring biased top latch 450*a* is pulled downwardly with sufficient force so that the spring biased latch 450*a* is disengaged from the top portion 412 and then the top portion 412 can be moved within the respective channels 434 of the base portion 430 to either the partially open position or the fully open position shown in FIGS. 14 and 15, respectively.
Figure 16C:
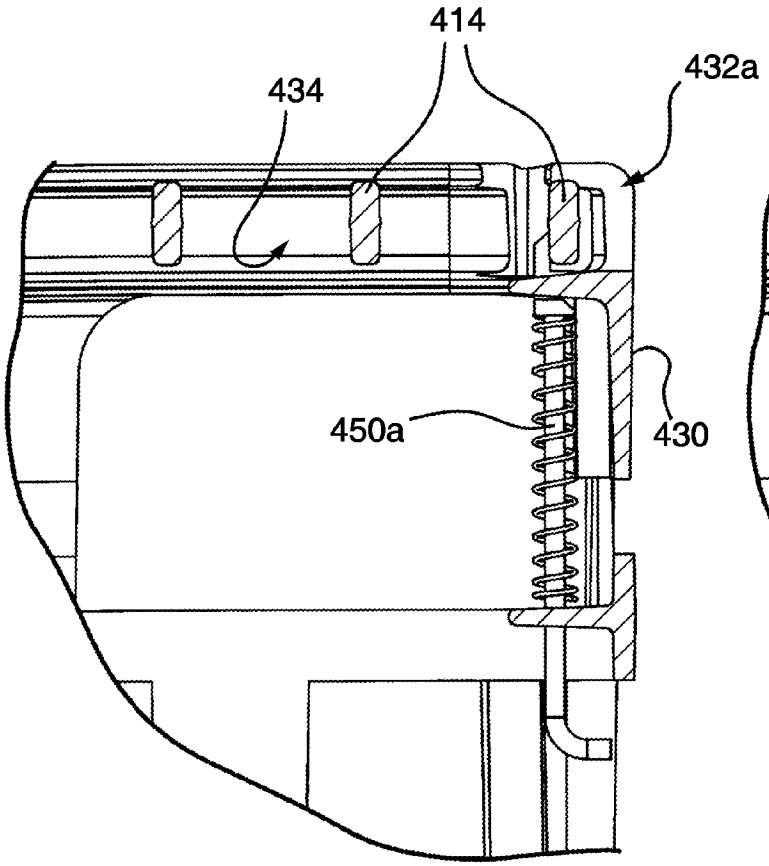
FIG. 16C is an enlarged cross-sectional side view of the dish rack 410, as viewed from the line 16C-16C of FIG. 13, illustrating the spring biased top latch 450*a* in an engaged position; wherein the top portion 412 cannot be moved with respect to the base portion 430.

FIG. 13 is a perspective view of another embodiment of a dish rack 410 of the present invention, the preferred dish rack 410 having a top portion 412, a bottom portion 422 and a base portion 430 having two latches 450*a*, 450*b*. In preferred embodiments, the top portion 412 and the bottom portion 422 each include a plurality of rails 414, 424 that slide within corresponding channels 434*a*, 434*b* in the base portion 430. The top portion 412 and the bottom portion 422 can each be secured to the base portion 430 with corresponding latches 450*a*, 450*b*. FIG. 14 is a perspective view of the dish rack of FIG. 13 illustrating the rails 414, 424 of the top portion 412 sliding within the respective channels 434*a* to provide access to the interior of the dish rack 410. FIG. 15 is a perspective view of the dish rack 410 of FIGS. 13-14 illustrating the top portion 412 in an open position, wherein all rails 414 are collected at one end of the dish rack 410 to provide access to the interior of the dish rack 410. FIG. 16A is a perspective view of the dish rack 410 of FIGS. 13-15 illustrating the top portion 412 in a latched or closed position; wherein the top latch 450*a* engages the top portion 412. FIG. 16B is an enlarged view of the dish rack of section 16B of FIG. 16A illustrating the latch 450*a* engaging the top portion 412. FIG. 16C is a cross-sectional view of the dish rack 410, proximate section 16B of FIGS. 16A and 16B, illustrating the latch 450*a* in an engaged position. FIG. 16D is a view similar to that of FIG. 16C, illustrating the latch 450*a* in a disengaged position; wherein the latch is pulled downwardly such that the latch 450*a* disengages the top portion 412.

Figure 17A:
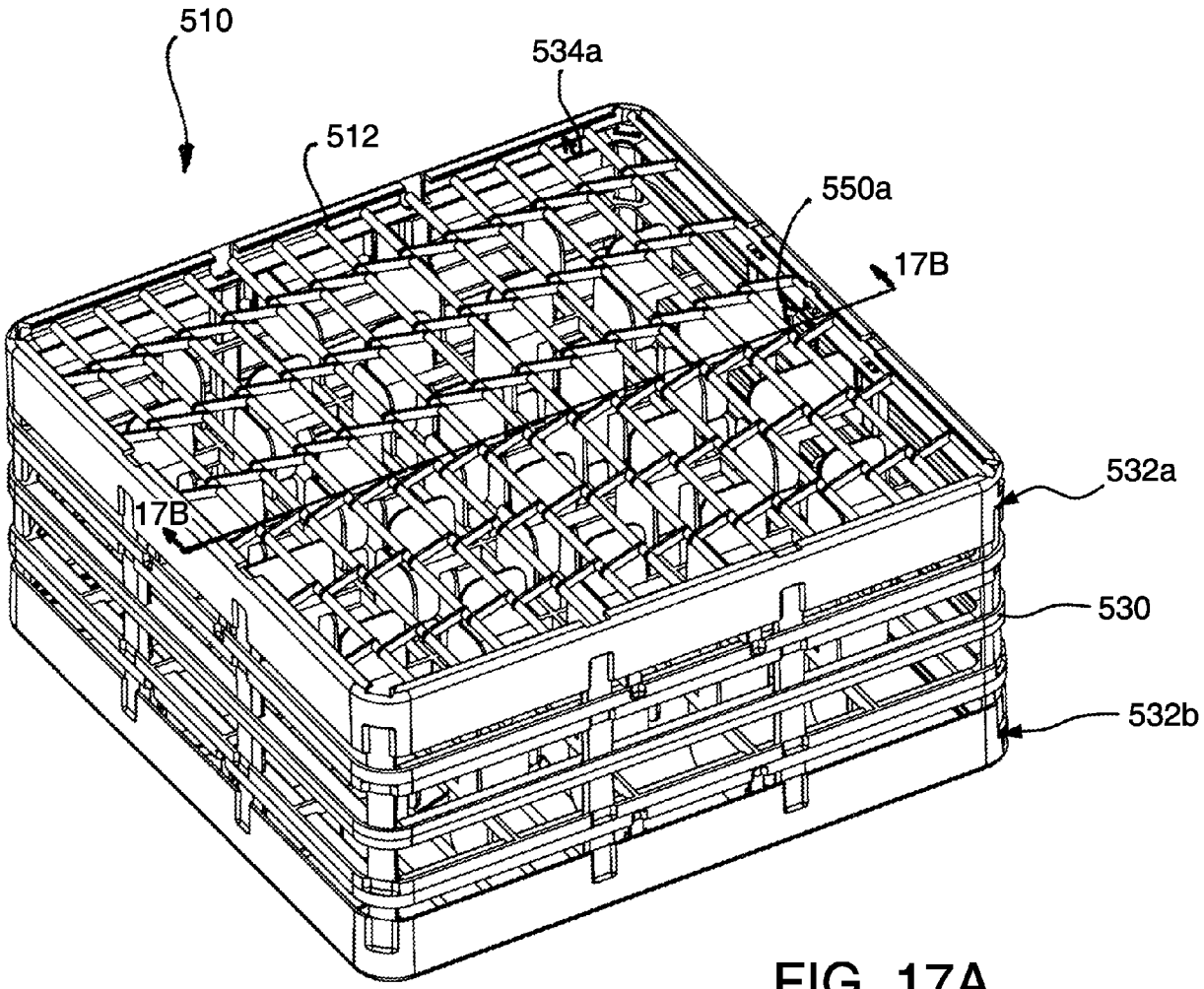
FIG. 17A is a perspective view of a sixth embodiment of a dish rack 510 of the present invention; the dish rack 510 having a top portion 512 and a bottom portion 522 that are each slideable within opposing channels 534 in an upper part 532*a* or a lower part 532*b*, respectively, of a base portion 530; the base portion 530 having an upper spring biased latch 550*a* and a lower spring biased latch (not shown) that operate in the same manner as the spring biased latches referenced in FIGS. 13-16D; wherein the top portion 512 and bottom portion 522 can be secured by the respective latches in a closed position as shown in FIG. 17A.
Figure 17C:
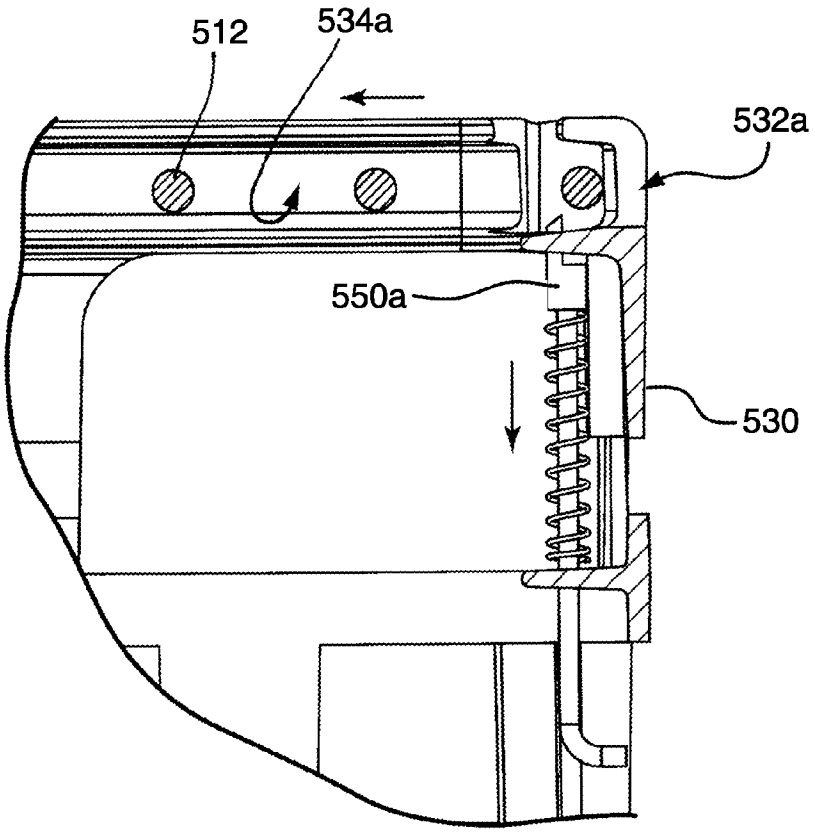
FIG. 17C is an enlarged cross sectional side view similar to that of FIG. 17B, illustrating the top latch 550*a* in a depressed disengaged position such that the top portion 512 can be retracted from the closed position shown in FIG. 17A.
Figure 17B:
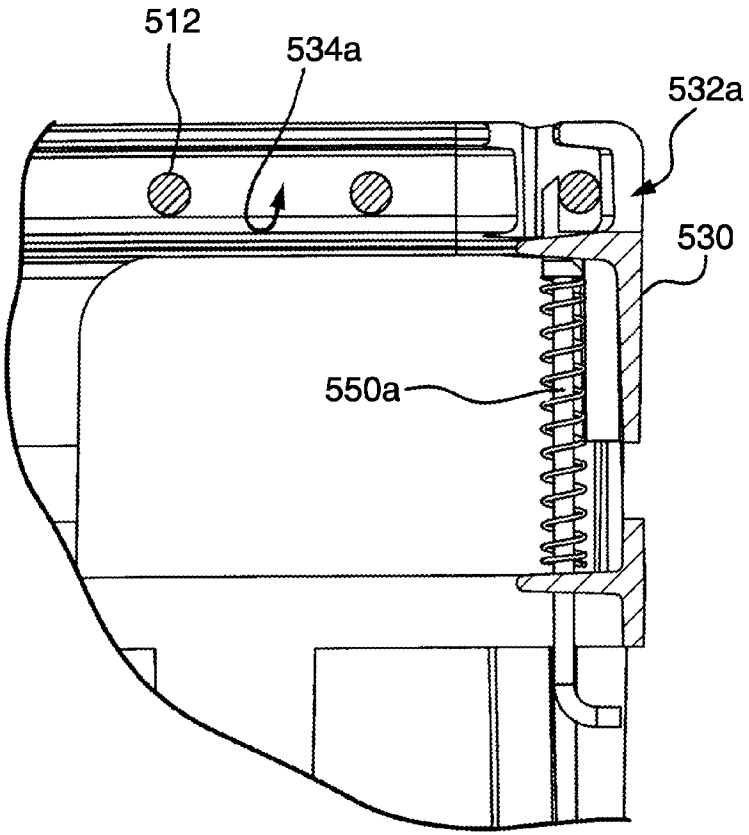
FIG. 17B is an enlarged cross sectional side view of the dish rack 510 of FIG. 17A as seen from the line 17B-17B, with a portion cut away to illustrate the top latch 550*a* in an engaged position.
Figure 18:
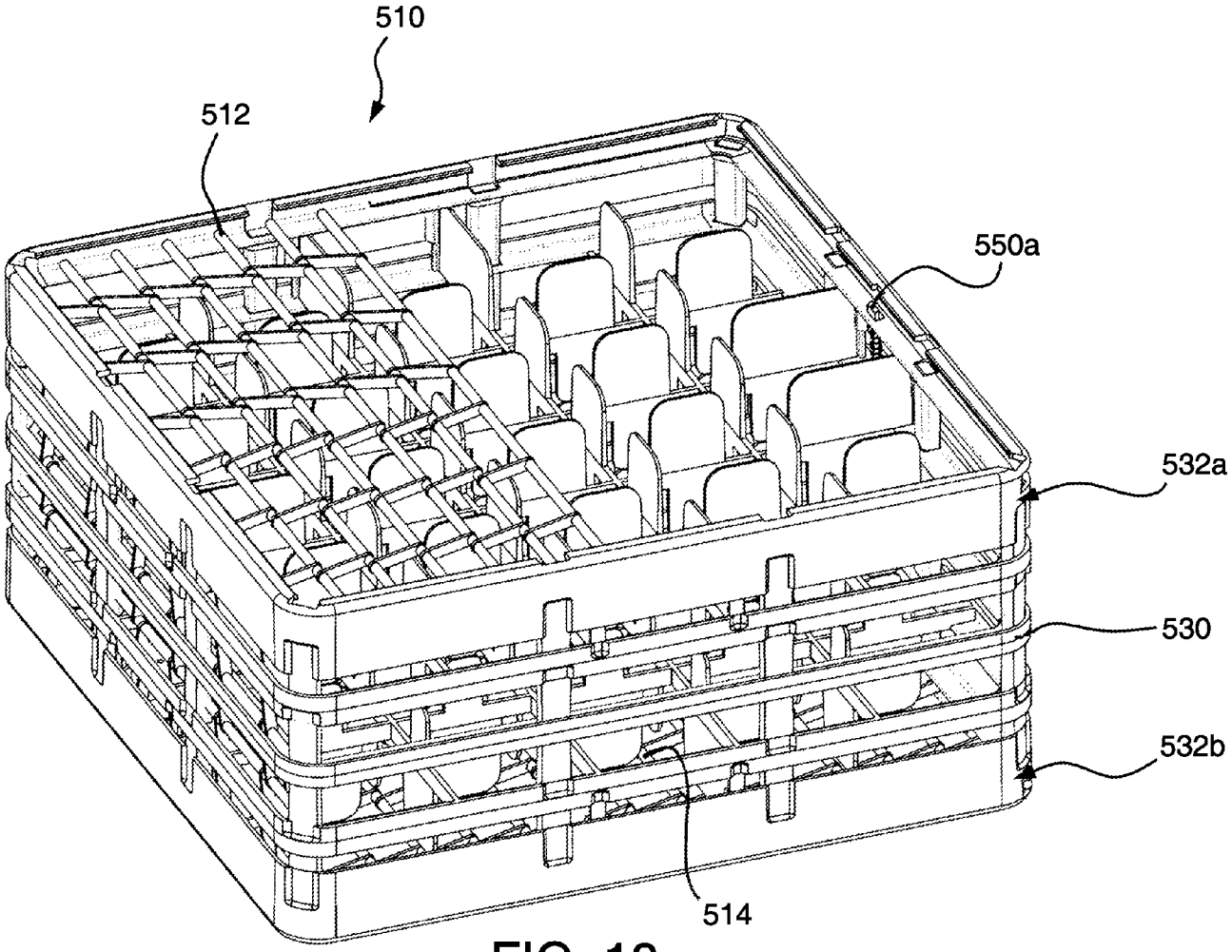
FIG. 18 is a perspective view of the dish rack 510 of FIGS. 17A-17C, wherein the top portion 512 is partially retracted to provide access to the interior of the dish rack 510.

FIG. 17A is a perspective view of yet another embodiment of a dish rack 510 of the present invention, the preferred dish rack 510 having a top portion 512, bottom portion 522 and a base portion 530 having two latches 550*a*, 550*b*. Preferably, one upper latch 550*a* and one lower latch 550*b*. The top 512 and bottom portions 522 can be secured in a closed position with the respective spring-biased latches 550*a*, 550*b*. FIG. 17B is a side view of the dish rack of FIG. 17 with a portion cut away to illustrate one preferred latch 550*a* engaging the top portion 512 in a closed position. FIG. 17C is a side view similar to that of FIG. 17B illustrating the latch 550*a* being pulled down into a disengaged position such that the top portion 512 can be retracted into an open position. FIG. 18 is a perspective view of the dish rack 510 of FIGS. 17A-16C, wherein the top portion is retracted to provide for access to the interior of the dish rack 510.

The use and operation of various dish racks disclosed herein is preferably as follows: one base portion is slidably engaged with and fully inserted into the body portion until it locks into place, and the dish rack is placed on a table or other surface disposed so that the inserted first base portion is at the bottom. The dish rack is then filled with soiled dishwares, and the second base portion is slidably engaged with the body portion and fully inserted into the body portion until it also locks into place, to serve as the top portion. The dish rack is then inverted where appropriate to drain, and the dishes may be pre-rinsed and further drained. The dish rack is then processed through any appropriate commercial dishwashing system, and thereafter may be inverted to drain if necessary. The dishes may be stored and stacked in the dish racks until reuse, or if desired, they may be chilled or iced in the racks prior to reuse. To dispense dishwares, the base portion functioning as the top portion is removed, and the dishwares are removed by hand.

One alternative embodiment of the invention utilizes color codes on the two base portions so that one is marked as a top portion and the other is marked as a bottom portion. The mode of operation is otherwise as discussed above. It will be understood that other top/bottom base indicators can also be used.

The dish rack further includes collars that preferably extend the height of the body portion that are attached to the body portion with prongs that engage sockets designed to receive the prongs. As one of ordinary skill in the art will appreciate, the collars are attached and removed as appropriate for the sizes and heights of the dishwares being handled.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described herein, the details may be changed without departing from the intended scope of the invention, which is defined by the attached claims.

The invention claimed is:

1. An invertible dishwashing rack, comprising:

a. a rectangular body portion that comprises a substantially single side wall, wherein the side wall bounds an interior volume configured for dishware storage and which contains at least one substantially vertical divider to separate the interior volume into at least two dishware storage regions, wherein the body portion is further configured to engage and detachably retain each of a top portion and a bottom portion when such top and bottom portions are associated with an upper part and a lower part of the body portion, respectively;

b. a top portion adapted to engage and be detachably retained by the upper part of the body portion, wherein the top portion contains a plurality of openings to allow passage of fluids but retain dishware placed in the dishwashing rack for cleaning and/or storage; and c. a bottom portion adapted to engage and be detachably retained by the lower part of the body portion, wherein the bottom portion contains a plurality of openings to allow passage of fluids but retain dishware placed in the dishwashing rack for cleaning and/or storage.

2. A dishwashing rack according to claim 1 wherein the upper part and/or lower part body portion is configured to slidably engage the top portion and/or the bottom portion adapted for sliding engagement of the upper part or the lower part of the body portion, respectively.

3. A dishwashing rack according to claim 1 wherein the body portion is formed by permanently or detachably directly connecting a plurality of multiple substantially identical wall elements to form the rectangular body portion.

4. A dishwashing rack according to claim 1 wherein the body portion comprises substantially parallel channels disposed on opposite sides of each of the upper part and the lower part of the body portion, wherein the channels are configured for sliding engagement of channel engaging elements disposed on opposite edges of the top and bottom portions.

5. A dishwashing rack according to claim 1 that further comprises a latch for detachable retention of at least one of the top portion and/or the bottom portion.

6. A dishwashing rack according to claim 1 wherein the top and bottom portions are interchangeable.

7. A dishwashing rack according to claim 1 wherein the top portion and/or bottom portion is(are) retained in the body portion via one or more latches.

* * * * *